US010435854B2

(12) United States Patent
Ivantchouk et al.

(10) Patent No.: US 10,435,854 B2
(45) Date of Patent: Oct. 8, 2019

(54) CONSTRUCTION METHODS AND SYSTEMS FOR GRADE SEPARATION STRUCTURES

(71) Applicant: Grade Separation Systems Inc., Carp (CA)

(72) Inventors: Artem Ivantchouk, Ottawa (CA); Eric William Carson, Ottawa (CA)

(73) Assignee: Grade Separation Systems Inc., Carp (CA)

( * ) Notice: Subject to any disclaimer, the term of this patent is extended or adjusted under 35 U.S.C. 154(b) by 0 days.

(21) Appl. No.: 16/100,454

(22) Filed: Aug. 10, 2018

(65) Prior Publication Data

US 2019/0071825 A1 Mar. 7, 2019

Related U.S. Application Data

(63) Continuation of application No. 16/077,103, filed as application No. PCT/CA2017/000021 on Feb. 1, 2017.

(30) Foreign Application Priority Data

Feb. 12, 2016 (CA) ..... 2920654

(51) Int. Cl.

| | |
|---|---|
| ***E01D 21/00*** | (2006.01) |
| ***E01B 29/02*** | (2006.01) |
| ***E02D 23/00*** | (2006.01) |
| ***E01B 2/00*** | (2006.01) |
| ***E01B 29/00*** | (2006.01) |
| ***E01D 1/00*** | (2006.01) |
| ***E02D 27/18*** | (2006.01) |

(Continued)

(52) U.S. Cl.

CPC ..... *E01D 21/00* (2013.01); *E01B 29/02* (2013.01); *E02D 23/00* (2013.01); *E02D 29/10* (2013.01); *E01B 2/00* (2013.01); *E01B 29/00* (2013.01); *E01D 1/00* (2013.01); *E02D 27/18* (2013.01); *E02D 29/02* (2013.01)

(58) Field of Classification Search

CPC . E01D 21/00; E01D 1/00; E01B 29/02; E01B 29/00; E02D 23/00; E02D 29/10; E02D 29/02; E02D 27/18

See application file for complete search history.

(56) References Cited

U.S. PATENT DOCUMENTS 1,970,979 A * 8/1934 Robb ..... E01D 6/00 14/77.1
2,658,353 A * 11/1953 Trexel ..... E02B 17/021 405/209

(Continued)

FOREIGN PATENT DOCUMENTS

JP 2005009309 A 1/2005

*Primary Examiner* — Abigail A Risic
(74) *Attorney, Agent, or Firm* — Porter, Wright, Morris & Arthur, LLP

(57) ABSTRACT

A cut and cover method of constructing grade separation structures includes partially burying precast substructure elements with associated trench boxes under live traffic. Once the precast substructure elements are buried, the substructure is completed and the bridge span is installed. Other methods include installing precast superstructure elements with a formwork system and forming a bridge substructure and excavating underneath the superstructure once the superstructure is formed.

10 Claims, 39 Drawing Sheets

(51) Int. Cl.
*E02D 29/00* (2006.01)
*E02D 29/02* (2006.01)

(56) References Cited

U.S. PATENT DOCUMENTS

| | | | | | |
|---|---|---|---|---|---|
| 2,972,234 | A | * | 2/1961 | Suderow | E02D 23/00 264/33 |
| 3,843,988 | A | | 10/1974 | Hirsch | |
| 4,075,453 | A | * | 2/1978 | Roberts | B23K 9/035 219/125.1 |
| 5,771,518 | A | * | 6/1998 | Roberts | E01D 19/02 14/73.1 |
| 5,839,852 | A | * | 11/1998 | Mattson | E01C 9/00 405/36 |
| 2012/0159893 | A1 | | 6/2012 | Anderson | |

* cited by examiner

CONSTRUCTION METHODS AND SYSTEMS FOR GRADE SEPARATION STRUCTURES

CROSS-REFERENCE TO RELATED APPLICATIONS

This application is a continuation of U.S. patent application Ser. No. 16/077,103 filed on Aug. 10, 2018

FIELD OF THE INVENTION

The present invention pertains to the field of construction methods and systems for grade separation structures and in particular, construction methods and systems which reduce or eliminate the need for long term traffic obstruction and temporary structures.

BACKGROUND OF THE INVENTION

Traditional methods of constructing grade separations involve significant closures and/or detours (shoo-fly) of both of the existing thoroughfares. Closures usually lead to increased commute times, resulting in higher costs of travel and greater greenhouse gas emissions. Constructing detours typically requires a costly protection system (retaining wall) to be constructed along the edge of the work site, which involves temporary piles and/or caissons. The detour also causes a shift in ownership and/or liability for the right-of-way throughout the duration of the project. Detouring railways in particular is a costly measure, requiring large amounts of space and extensive coordination between multiple land owners, contractors and consultants. A current alternative to detouring railways involves temporarily supporting existing rail tracks during underpass construction. These existing rail track support systems are very costly, and also require a great amount of temporary works.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide construction methods and systems for grade separation structures. In accordance with an aspect of the present invention, there is provided a method for constructing a grade separation structure at intersection of two thoroughfares comprising installing pairs of caisson liners along a first thoroughfare; wherein the caisson liners are substantially centred on the intersection; providing pre-cast concrete segment with a first end and second end; connecting a modular trench box to the first end of the precast segment and connecting a second modular trench box to the second end of the precast segment to form a pre-cast assembly; excavating a trench across the thoroughfare and around a pair of caisson liners, wherein the trench is sized to accommodate the precast assembly; installing the precast assembly in the trench such that a first caisson liner is position in the first trench box and a second caisson liner is positioned in the second trench box; filling the trench with ballast material thereby burying the precast assembly; filling the first and second caisson liners with reinforced cast-in-place concrete; linking the precast segments to the caissons; installing bearings and finishing works on the caissons to complete bridge substructure; preparing the completed bridge substructure for bridge span installation; and installing bridge span; wherein following installation of the bridge span underpass is excavated and thoroughfares reinstated.

In accordance with another aspect of the invention, there is provided a method for constructing a grade separation structure at a thoroughfare comprising providing precast substructure elements with associated trench boxes; excavating a trench across the thoroughfare; installing the precast substructure elements with associate trench boxes in the trench; filling in at least part of the trench to reinstate the thoroughfare to live traffic; completing the substructure; and installing bridge span on the substructure.

In accordance with another aspect of the present invention, there is provided a method for constructing a grade separation structure comprising providing precast superstructure elements with formwork system, wherein the precast superstructure elements comprises a partial concrete deck; installing the precast superstructure elements with formwork system; extending the partial concrete deck with cast-in-place concrete; forming substructure elements; completing superstructure and attaching the substructure elements to the superstructure; and excavating beneath the superstructure to form an underpass.

In accordance with another aspect of the invention, there is provided a method of protecting a vertical face excavation under a superstructure supported by caissons, the method comprising a) partially excavating a vertical face between two caissons under the superstructure, wherein an integral channel is provided between the two caissons proximal to the superstructure; and b) sliding a first steel waler horizontally along the integral channel guide; c) excavating under the installed first steel waler such that the first steel waler descends to the bottom of the excavation site; and d) sliding a second waler on top of the first steel waler.

BRIEF DESCRIPTION OF THE FIGURES

These and other features of the invention will become more apparent in the following detailed description in which reference is made to the appended drawings.

FIG. 23A shows the pre-excavation site. FIG. 23B details local excavation site (19). FIG. 23C details location of integral channel (18) relative to caisson liners (1) and pre-cast element (4). FIG. 23D shows relationship between integral channel (18) and first waler (17).

DETAILED DESCRIPTION OF THE INVENTION

Figure 1:
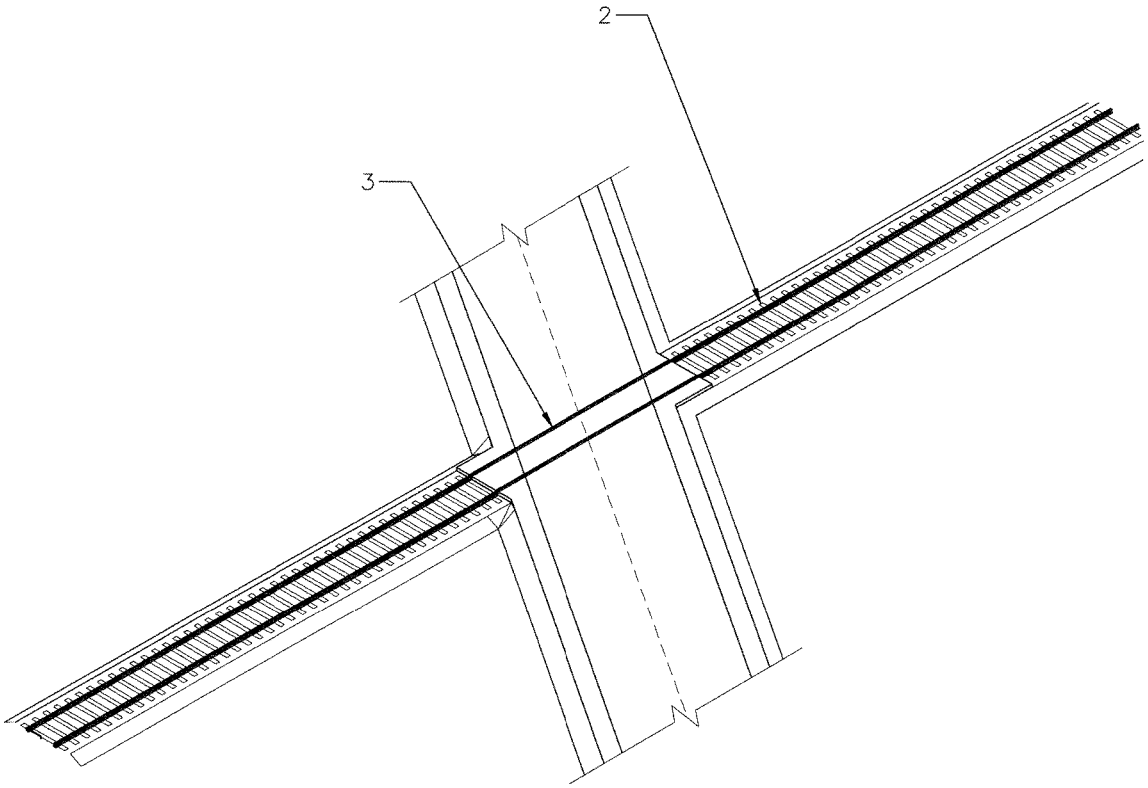
FIG. 1 is a schematic detailing a level crossing (3). Rail track (2) is shown.

Overview:

This invention provides methods for constructing a grade separation structure using precast substructure or superstructure elements with trench boxes and/or formwork systems to be partially buried under live traffic thereby minimizing the thoroughfare closure period. The trench boxes and/or formwork systems are optionally modular and/or configured to provide design flexibility. The method is amenable to different intersection configurations and can, in some embodiments, be used to realign a thoroughfare. The methods can also be used for the construction of new underpasses and the widening of existing thoroughfares. The size and dimensions of the system and the steps in the method can be modified to suit a wide range of geometries.

In some embodiments, where two or more rows of caissons are required, the trench boxes are optionally bolted to two precast elements simultaneously, for example at each end thereby allowing for the construction of multi-lane/multi-track bridges.

This cut and cover method can be repeated for each of the substructure/superstructure elements or could be performed for multiple segments simultaneously within the same closure period. In some embodiments, the method would minimize the closure periods to four to six hours.

Precast substructure or superstructure elements can be of a standard or generic design or configuration. Alternatively, the precast substructure or superstructure elements can be specifically designed for the specific grade separation structure. Optionally, conduits for cables, pipes or other infrastructure can be integrated. In some embodiments, the pre-cast elements include integral ballast walls. The pre-cast elements can be single pieces or can be multi-piece. The trench boxes are custom designed to suit this technology but optionally have standardized dimensions usable in most applications.

The precast substructure or superstructure elements may be cast on-site or cast elsewhere and delivered to the site.

The precast elements can be provided with pre-cast inserts to facilitate connection to the trench boxes. These inserts can optionally be configured as threaded sleeves.

In some embodiments, the method utilizes pre-assembled steel elements that include trench boxes/formwork and the steel bridge spans.

The method optionally utilizes elements to facilitate completion work including elements to facilitate construction of retaining walls. In one embodiment, the method provides channel guides extending between the caissons.

In one embodiment, the channel guides consist of three steel plates welded together into a "C" shape and are configured to house the first waler. The channel is tack welded to the caisson liners.

This invention provides methods and systems that facilitate the completion of a grade separation without significant closures or detours to route that will form the future overhead thoroughfare. In some embodiments, it allows for a minimization of the disruption of both thoroughfares.

In some embodiments, the method facilitates the completion of critical components of the grade separation structure without significant disruptions to public right-of-way by using precast concrete segments and/or pre-assembled steel elements provides for portions of the grade separation structure.

The construction work directly beneath the overhead thoroughfare, i.e. placing prefabricated elements, can be performed in short-term closure periods of approximately four to six hours. The remainder of the work (caissons, bearings, wingwalls, etc.) is then completed outside of the clearance envelope of the thoroughfare without significant closures and/or detours. The remainder of the construction will be completed using well adopted construction techniques and can be constructed by any competent heavy civil contractor using widely available equipment and without any additional training.

The equipment used to place the bridge spans may be case specific, and dependent on the weight of the segments. In most cases, the spans can be positioned in place using tandem mobile cranes. If the weight of the span exceeds the practical mobile crane lift capacity, a lateral slide could be utilized within a similar closure period of four to six hours.

This method is applicable to structures designed to support any type of traffic including railways in accordance with the regulatory design codes/manuals including CSA S6-14 Canadian Highway Bridge Design Code, AREMA Manual and, AASHTO LRFD Bridge Design Specifications.

Unless defined otherwise, all technical and scientific terms used herein have the same meaning as commonly understood by one of ordinary skill in the art to which this invention belongs.

To gain a better understanding of the invention described herein, the following examples are set forth. It will be understood that these examples are intended to describe illustrative embodiments of the invention and are not intended to limit the scope of the invention in any way.

EXAMPLES

Example One

Three Span Rail Crossing

Figure 2:
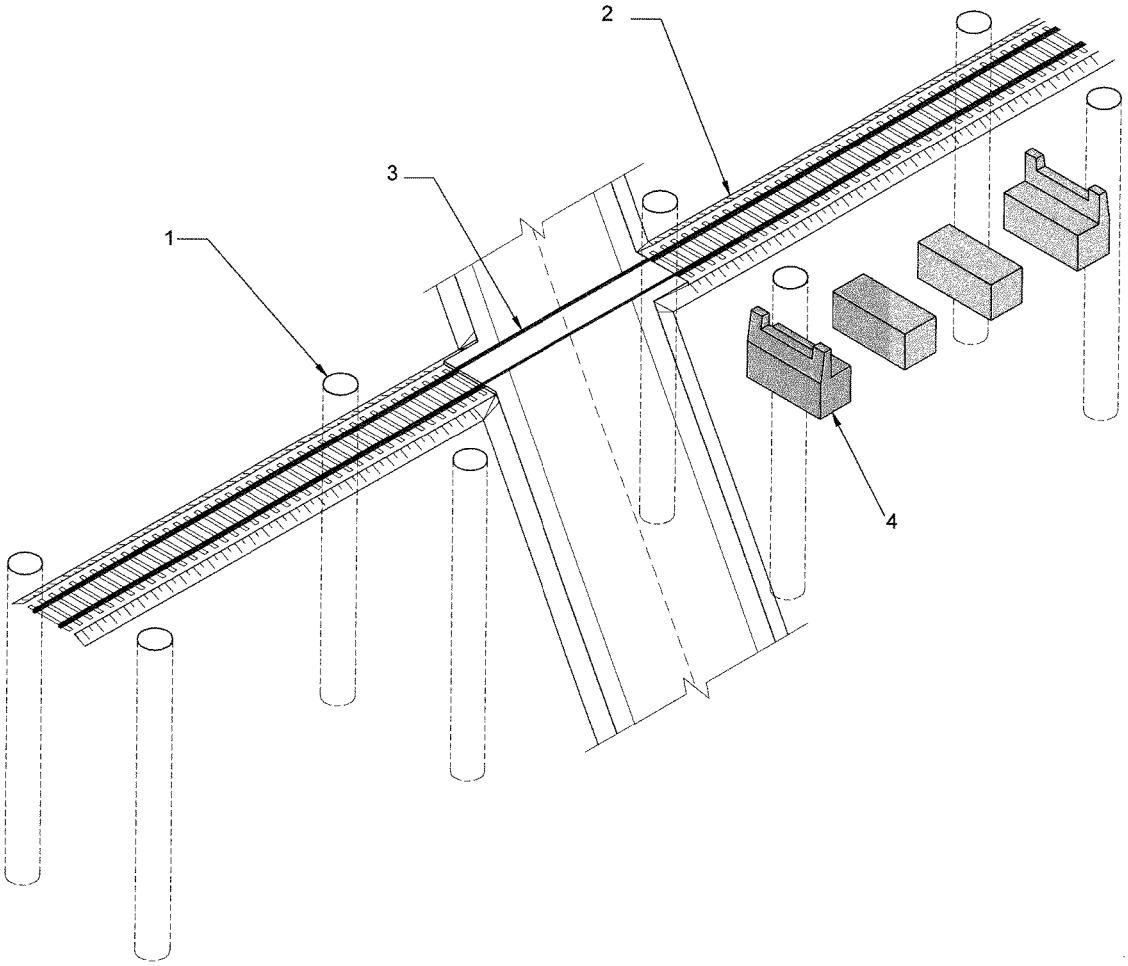
FIG. 2 is a schematic detailing placement of steel caisson liners (1) along each side of rail track (2) outside the railway clearance envelope for a three span rail crossing. Also shown is location of level crossing (3) and precast portions of pier caps (4) configured with and without an integral ballast wall.

FIGS. 2 to 13 illustrate construction of a three span rail crossing with minimized disruption of traffic flow. Steel caisson liners (1) are installed along each side of the railway track (2) in substantially parallel pairs. The set of steel caisson liners are substantially centred on the existing level crossing (3) as shown in FIG. 2. Once installed, the caissons form part of the permanent foundations of the future structure. The liners are installed outside of the railway clearance envelope, and therefore can be installed without disruptions to either of the existing thoroughfares. On site, contemporaneously, portions of the pier caps (4) and/or the abutment walls are precast (4) with reinforced concrete and/or post-tensioning ducts.

Figure 3A:
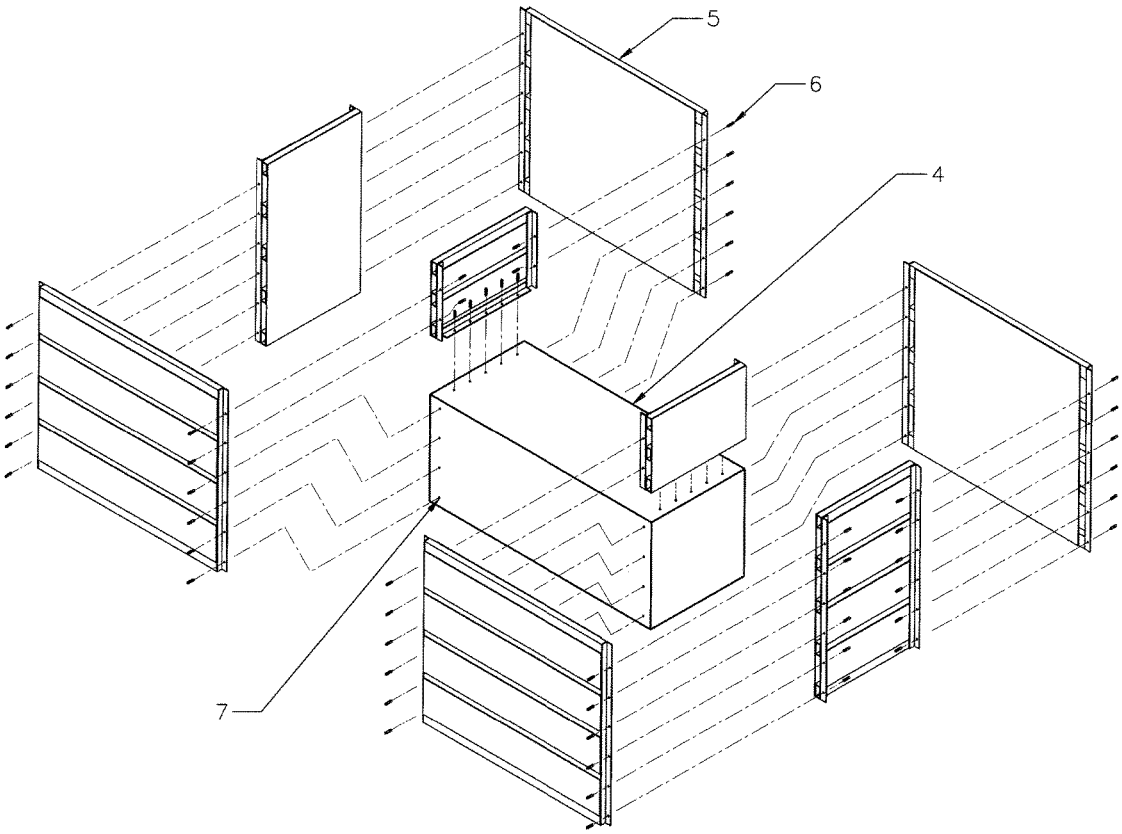
FIGS. 3A and 3B are schematic detailing constructions of modular trench boxes (5) and attachment to precast elements (4) with cast-in inserts (7) to form a pre-cast assembly.
Figure 3B:
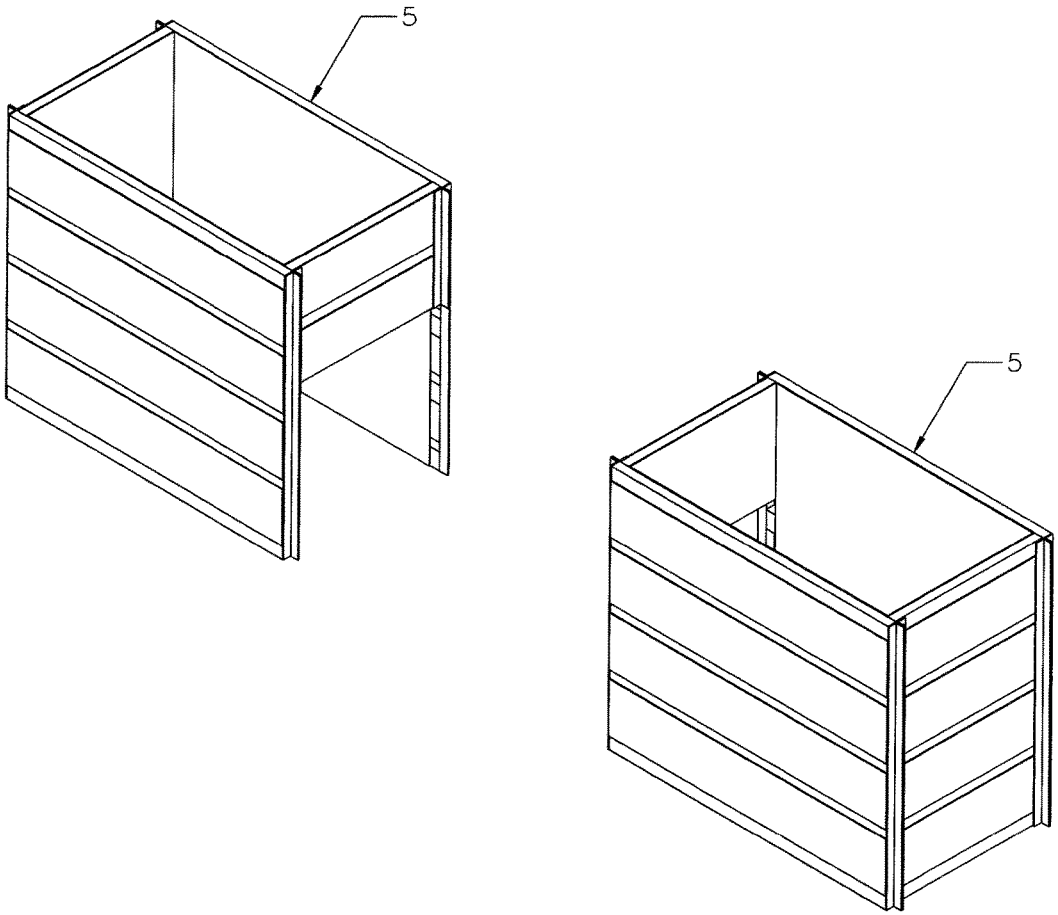
Figure 4:
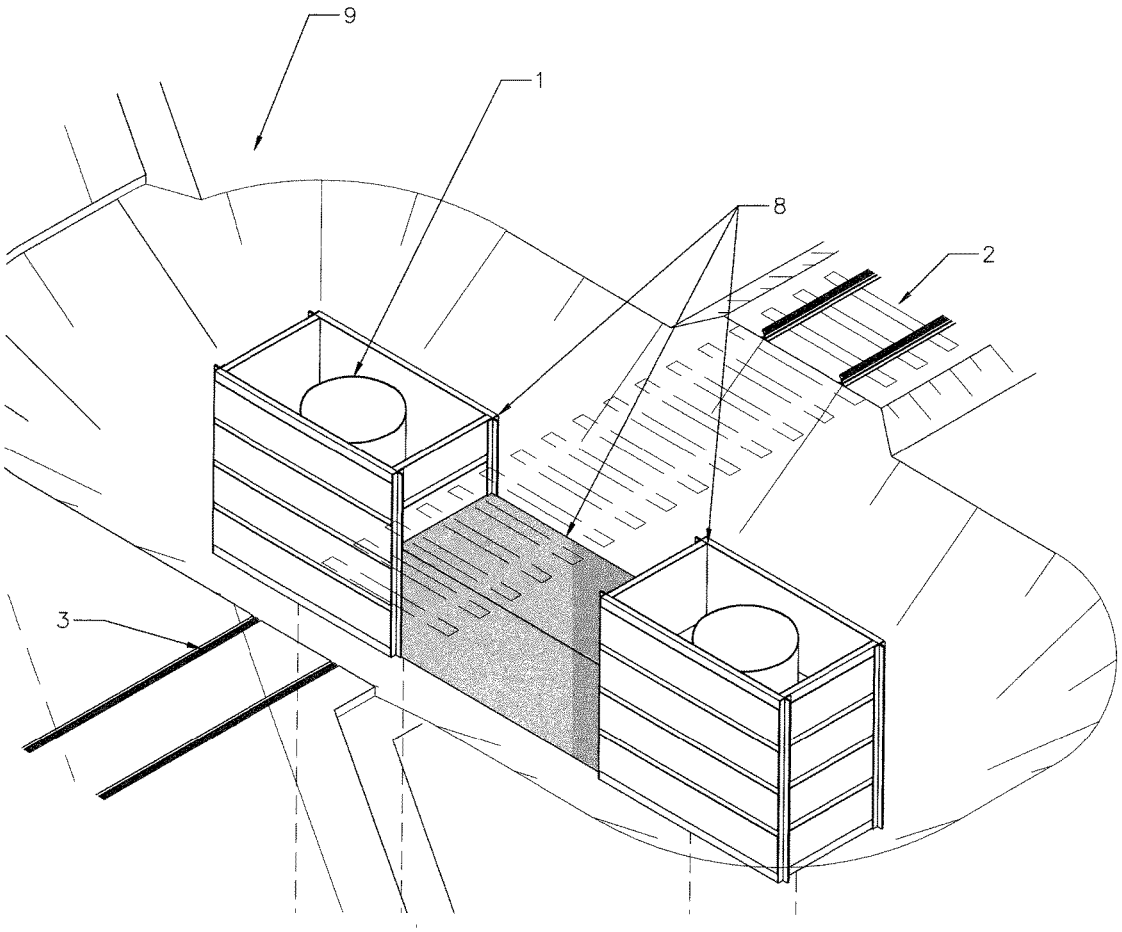
FIG. 4 is a schematic detailing placement of the pre-cast assembly (8) over the steel caisson liners (1) in trench (9) excavated across the thoroughfare. Rail track (2) is shown and location of level crossing (3).
Figure 6:
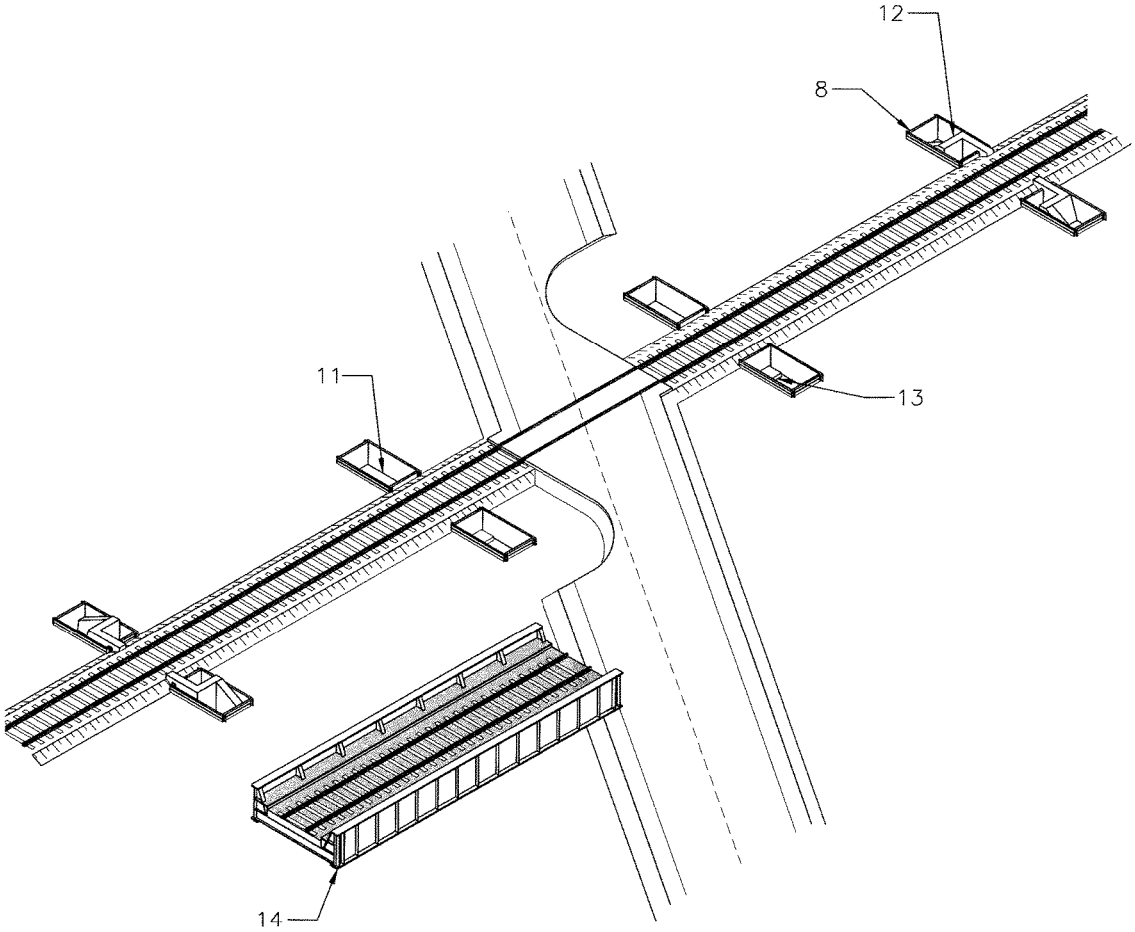
FIG. 6 is a schematic detailing completion of substructure elements. Ballast walls (12), cast-in place concrete (11) and bearings (13) are shown. Also shown is a completed rail bridge span (14) and part of the pre-cast assembly (8).

During the precasting work, the right of way which is to be re-aligned under the overhead thoroughfare, is detoured around the work site as required. Once it is detoured, there would be no additional closures or disruptions to this thoroughfare required for construction operations. Once the precast segments have cured, modular trench boxes (5) can be connected to the precast segments, for example cast-in inserts (7) using bolts (6) (7) as shown in FIG. 3. When the caisson liners are installed and the precast segments are assembled with the trench boxes (8), the thoroughfare is closed for a short-term period and the rail track temporarily disassembled. Referring to FIG. 4, a trench is excavated (9) across the thoroughfare, large enough to accept the precast assembly (8) as shown in FIG. 4. The precast assembly is position over the caisson liners in the trench (9), by mobile crane for example, at its final location, orientation and elevation. Once the assembly is in place, the trench is filled with ballast material, burying the precast assembly (8), and the thoroughfare is reinstated as shown in FIG. 6.

Figure 5:
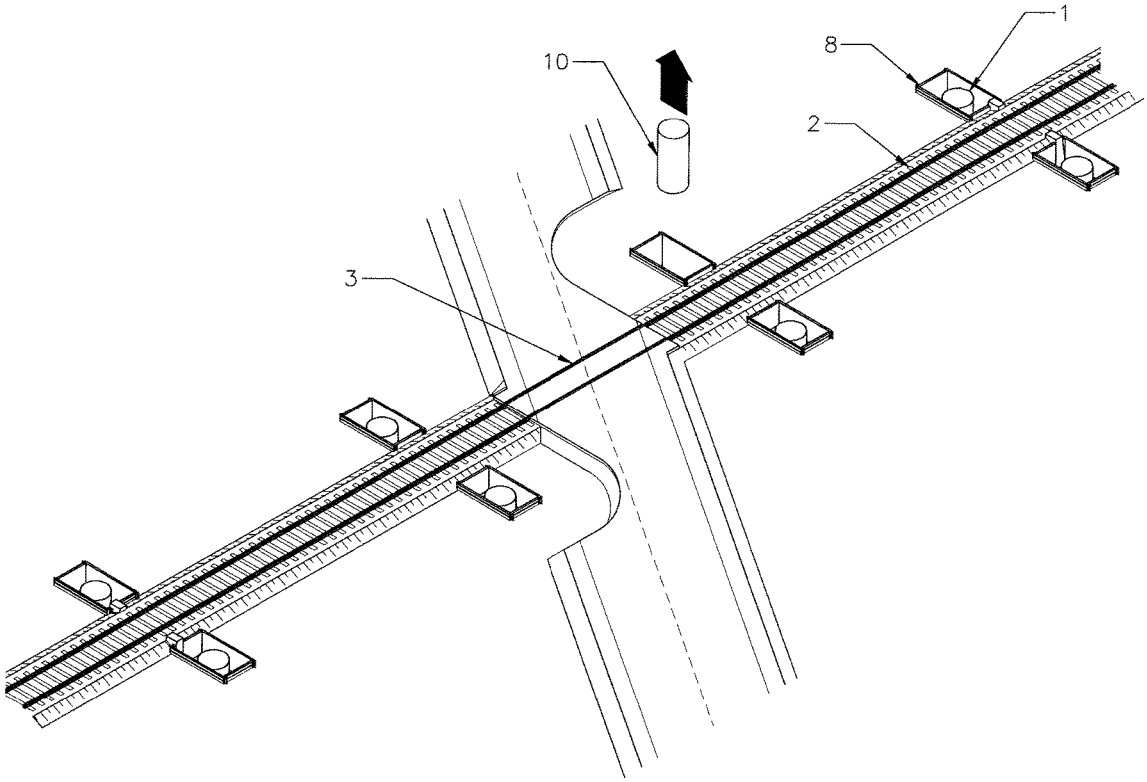
FIG. 5 is a schematic detailing reinstatement of thoroughfare at the level crossing (3). Also shown is removal of a piece of the steel caisson liner (1), rail track (2), and pre-cast assembly (8).

The previously installed caisson liners (1), which are now enclosed by the trench boxes as seen in FIGS. 4 and 5, are, if necessary, cut to the appropriate length to provide the design elevation and the cut piece (10) removed as shown in FIG. 5. The caissons are then be filled with reinforced cast-in-place concrete. If the exposed portion of the pier column is a smaller diameter than the buried caisson, a formwork collar is lowered into the liner prior to pouring the concrete. Then the precast segments are extended utilizing the trench boxes as formwork for the cast-in-place concrete (11) thereby linking the precast segment to the caissons (FIG. 5).

The cast-in-place concrete is made integral with the precast segments using mechanical reinforcing steel couplers and/or post tensioning. Finally, the ballast walls (12), bearings (13) and finishing works on the substructure elements are completed. Prior to finishing the bridge substructure, the bridge spans (14) are cast/assembled including ballast and rail tracks as shown in FIG. 5.

Figure 7:
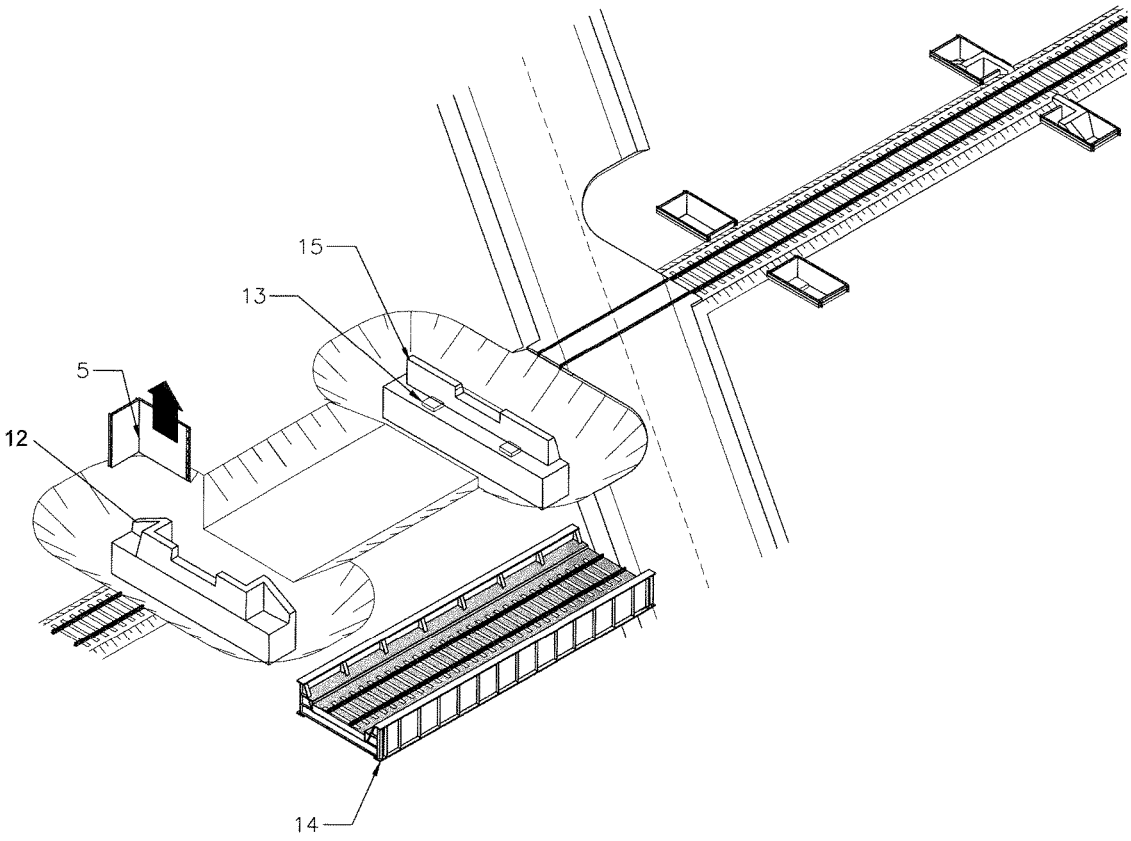
FIG. 7 is a schematic detailing preparation for installation of first span. Ballast walls (12), bearings (13), and disassembled trench box piece (5) are shown. Also shown is a completed rail bridge span (14) ready for installation and temporary end cap (15).
Figure 8:
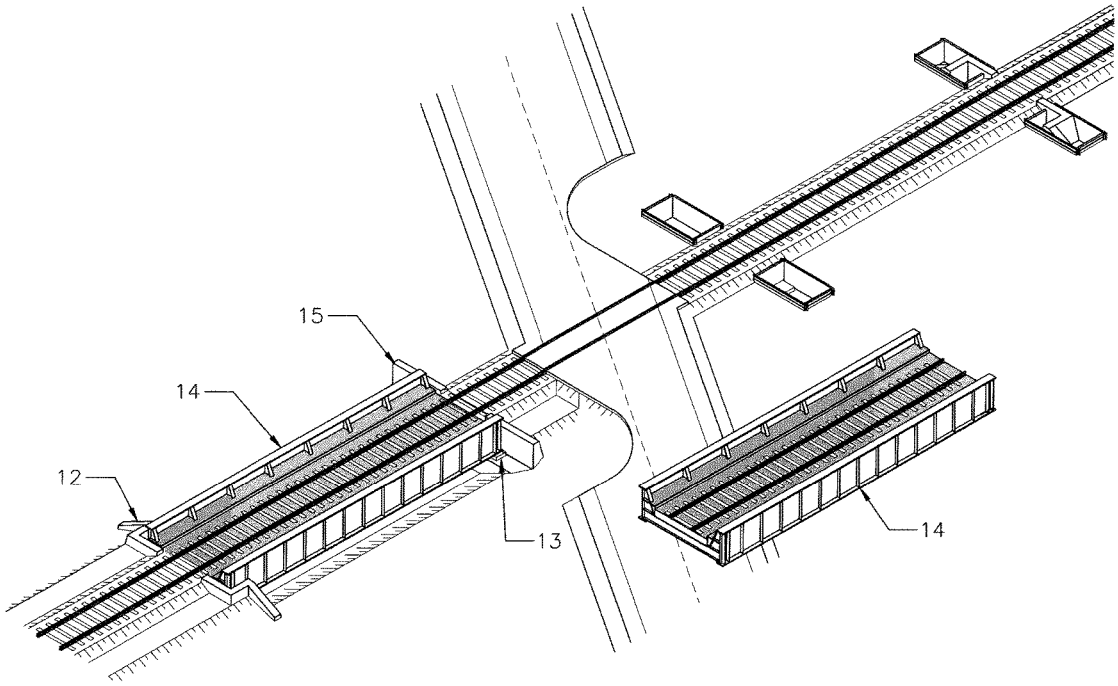
FIG. 8 is a schematic detailing placement/installation of the first span. Ballast walls (12), bearings (13) are shown. Also shown is a completed rail bridge span (14) and temporary end cap (15).
Figure 9:
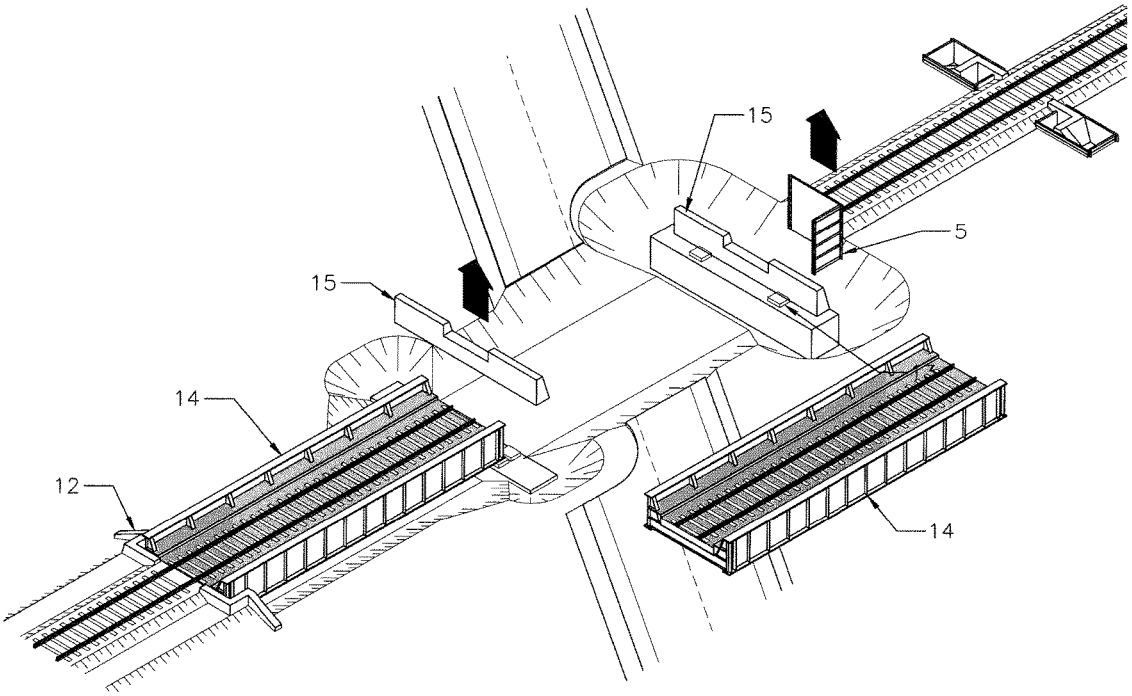
FIG. 9 is a schematic detailing preparation for installation of the second span including removal of temporary end cap (15) and disassembly of trench box (5). Ballast walls (12) and bearings (13) are shown. Also shown is a completed rail bridge span (14).
Figure 10:
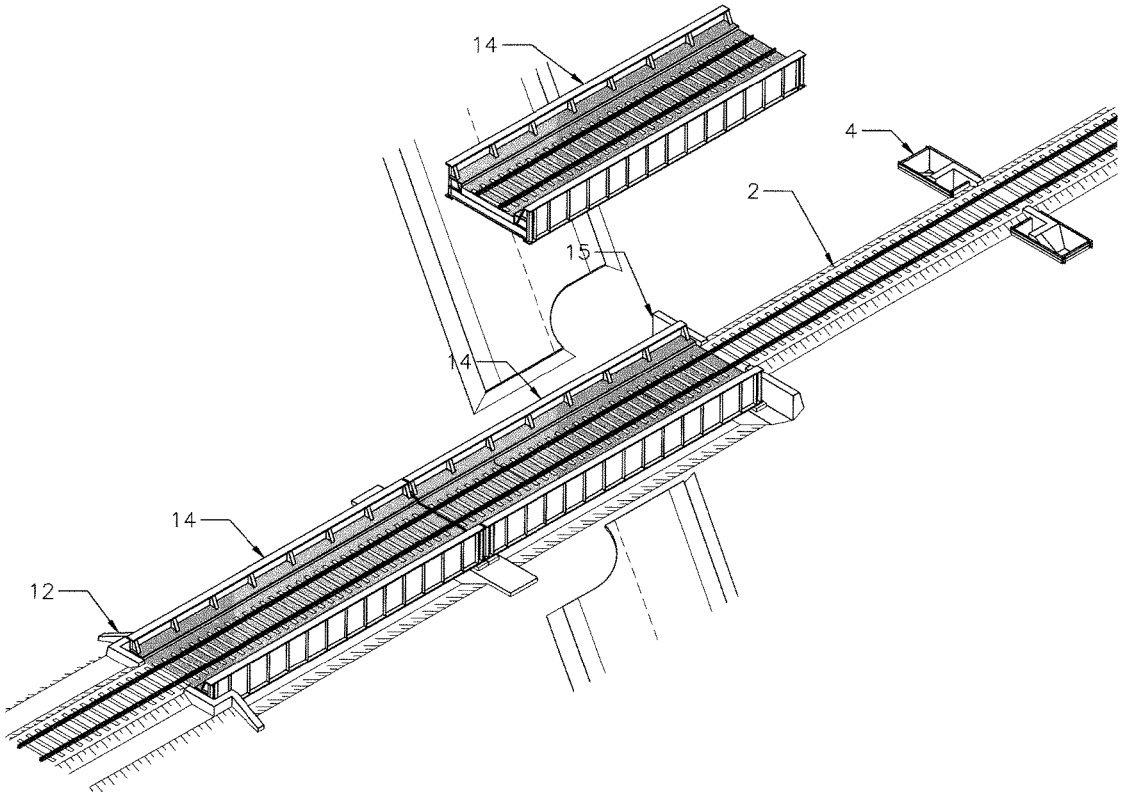
FIG. 10 is a schematic detailing placement/installation of the second span. Ballast walls (12), temporary end caps (15) and trench box with precast components (4) are shown. Also shown are rail bridge spans (14) including the third span ready for installation and rail track (2).
Figure 11:
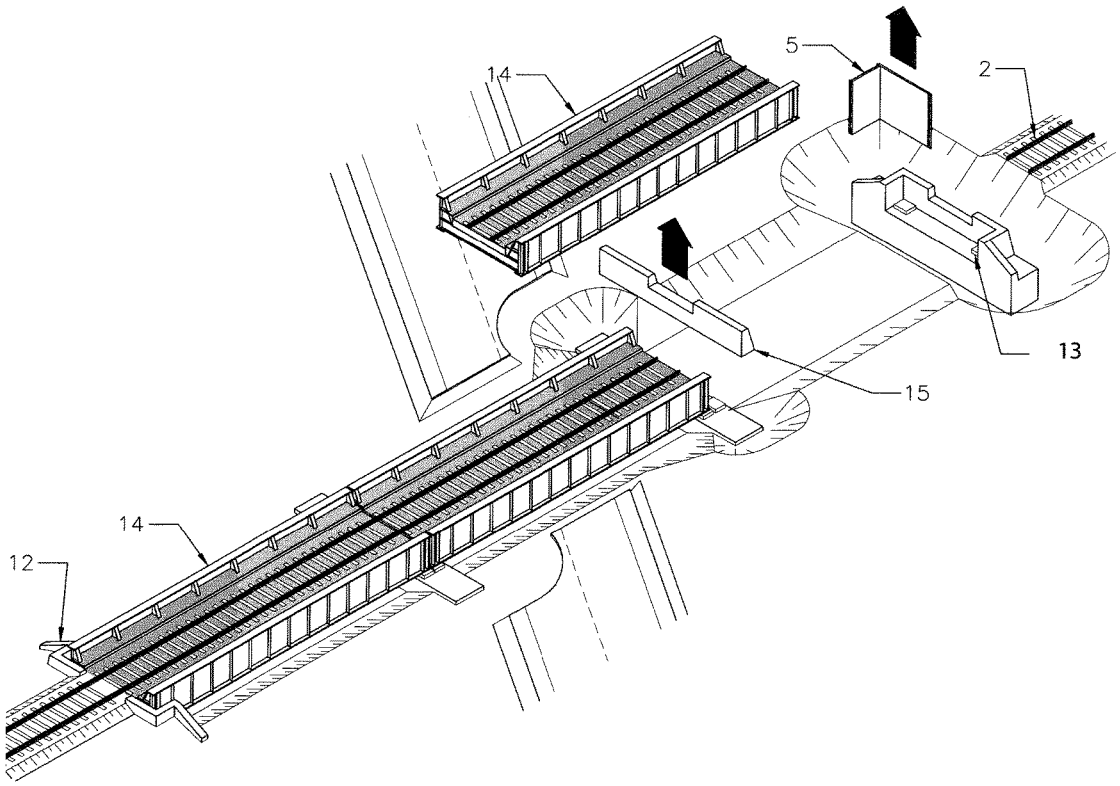
FIG. 11 is a schematic detailing preparation for installation of the third span detailing removal of the temporary end cap (15). Ballast walls (12), bearings (13), and disassembled trench box piece (5) are shown. Also shown is a completed rail bridge span (14).
Figure 12:
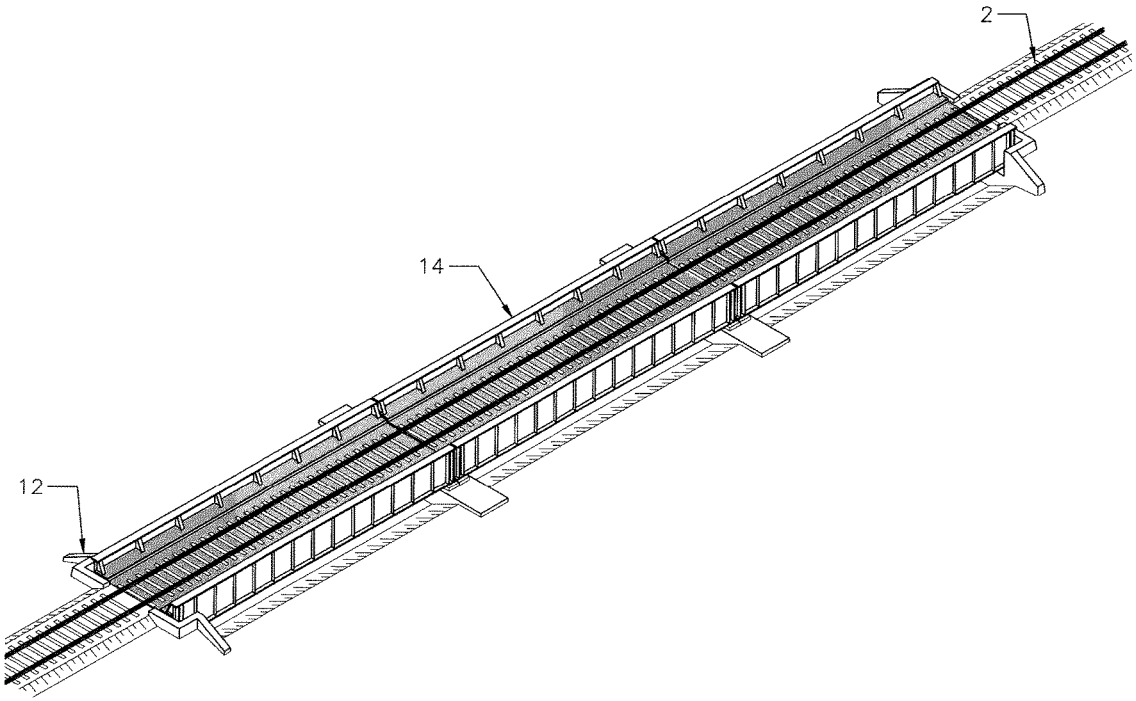
FIG. 12 is a schematic detailing placement of the third span showing ballast wall (12), bridge spans (14) and rail track (2).

Once the substructure and superstructure elements are completed, the thoroughfare is temporarily closed for installation of the bridge spans. A portion of the rail track is disassembled and the filled trench is at least partially excavated to provide access to the partially buried precast assemblies (8) as shown in FIG. 7. The trench boxes (5) are disassembled and removed from the completed pier caps and/or abutments. The pre-assembled bridge spans (14) are positioned into place onto the final bearings (13) using, for example. If required, temporary end cap/ballast wall(s) (15) are provided. Placement of the remaining spans is shown in FIGS. 8 to 12.

Figure 13:
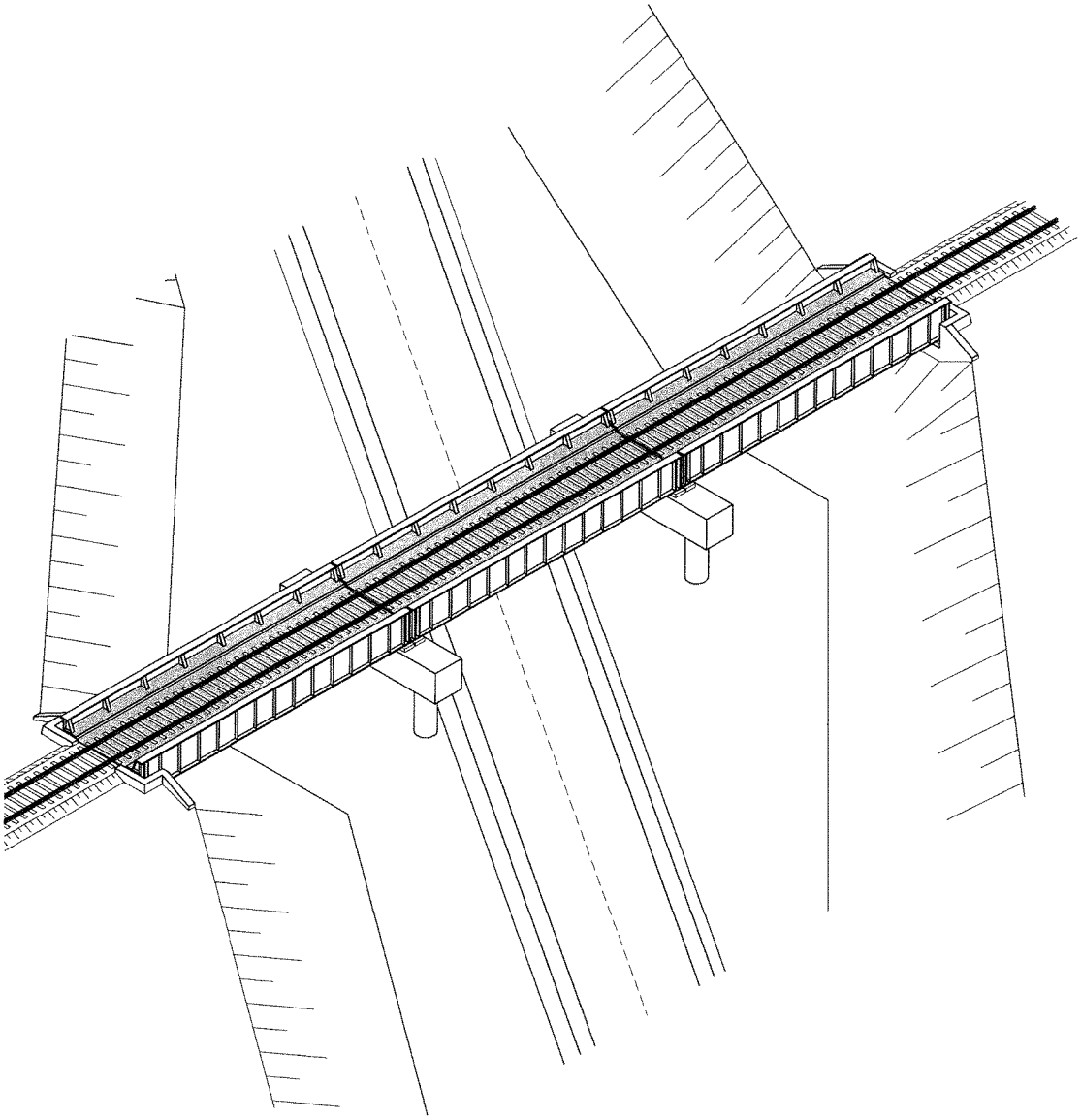
FIG. 13 is a schematic detailing completed three span rail bridge.

Upon completion of each of the bridge spans, the overhead thoroughfare would be re-opened to live traffic. After completion of the structure, excavation of the underpass and final completion is begun. Once final excavation works are completed, the portions of caisson liners at the piers, which have been exposed, are optionally removed from the concrete columns. The sides of the excavation adjacent to the abutments are optionally completed with slope paving. An example of a completed structure is shown in FIG. 13.

This three span system could also allow for future widening of both thoroughfares with only minor modifications. Widening of the lower thoroughfare would be completed by removing the slope paving and constructing an vertical abutment face.

The overhead thoroughfare could be widened by installing an additional row of caissons parallel to the previously constructed spans. The abutments and piers would then be extended to join these additional caissons and new bridge spans placed on the extensions creating a new right-of-way for the overhead thoroughfare.

Example Two

Single Span Rail Crossing with Vertical Abutment Faces

The construction sequence of a single span rail crossing with vertical abutment faces is illustrated in the example below.

Figure 14A:
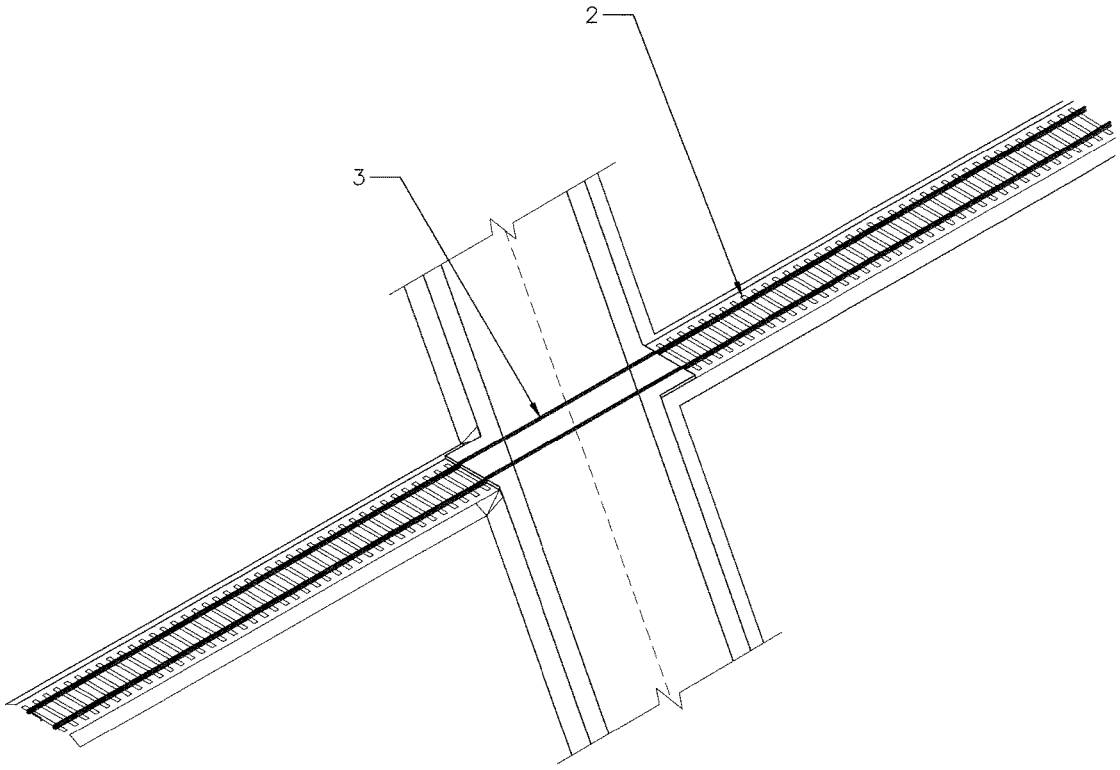
FIG. 14A is a schematic detailing a level crossing (3) prior to installation of a single span rail crossing.
Figure 14B:
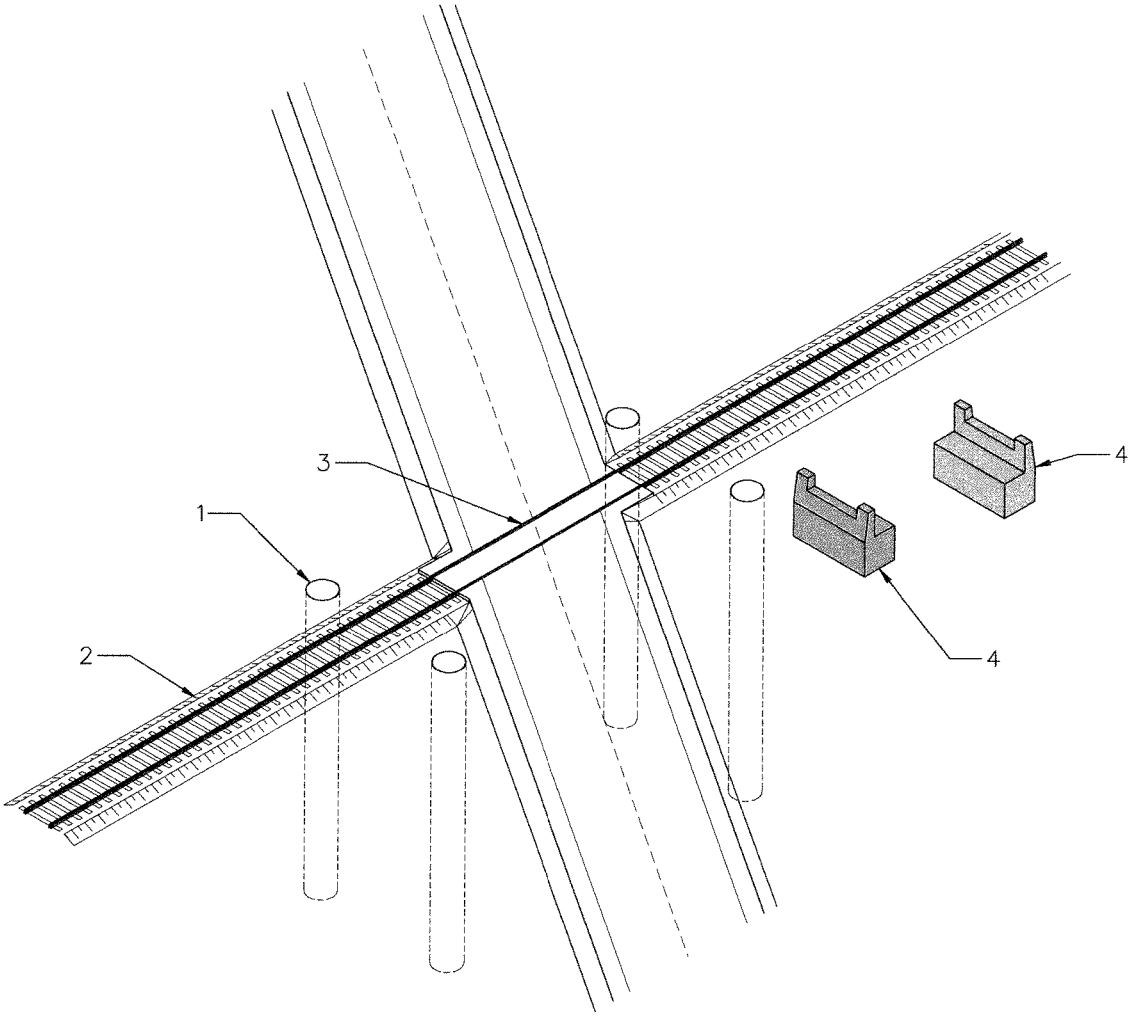
FIG. 14B is a schematic detailing placement of steel caisson liners (1) along each side of rail track (2) outside railway clearance envelope for a single span rail crossing. Also shown is location of level crossing (3) and precast portions of pier caps (4) with integral ballast walls.

Referring to FIG. 14, steel caisson liners (1) are installed along each side of the overhead thoroughfare (2) and centred on the existing level crossing (3). On site, contemporaneously, portions of the pier caps and/or the abutment walls, and/cast-in inserts are precast with reinforced concrete and/or post-tensioning ducts.

Figure 15:
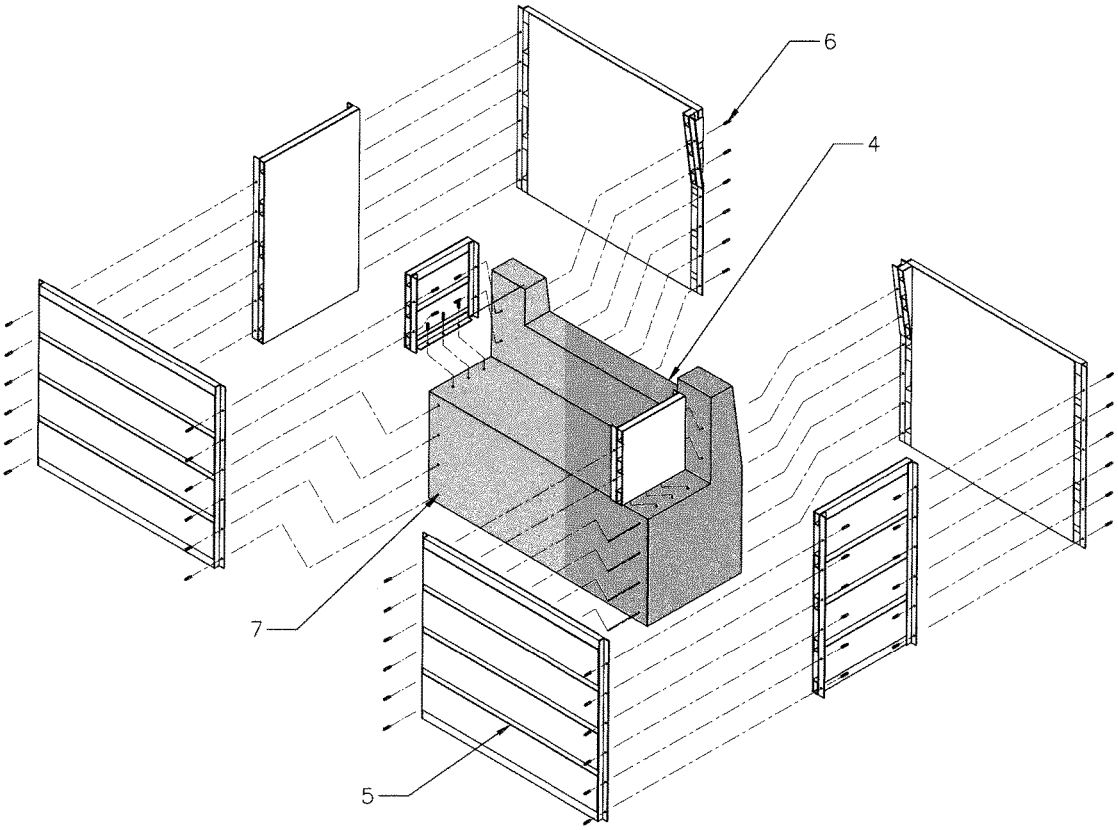
FIG. 15 is schematic detailing constructions of modular trench boxes from trench boxes pieces (5) and attachment to pre-cast elements with integral ballast wall (4) with bolts (6) to form a pre-cast assembly. Also shown are precast inserts (7) into which the bolts are threaded.
Figure 16:
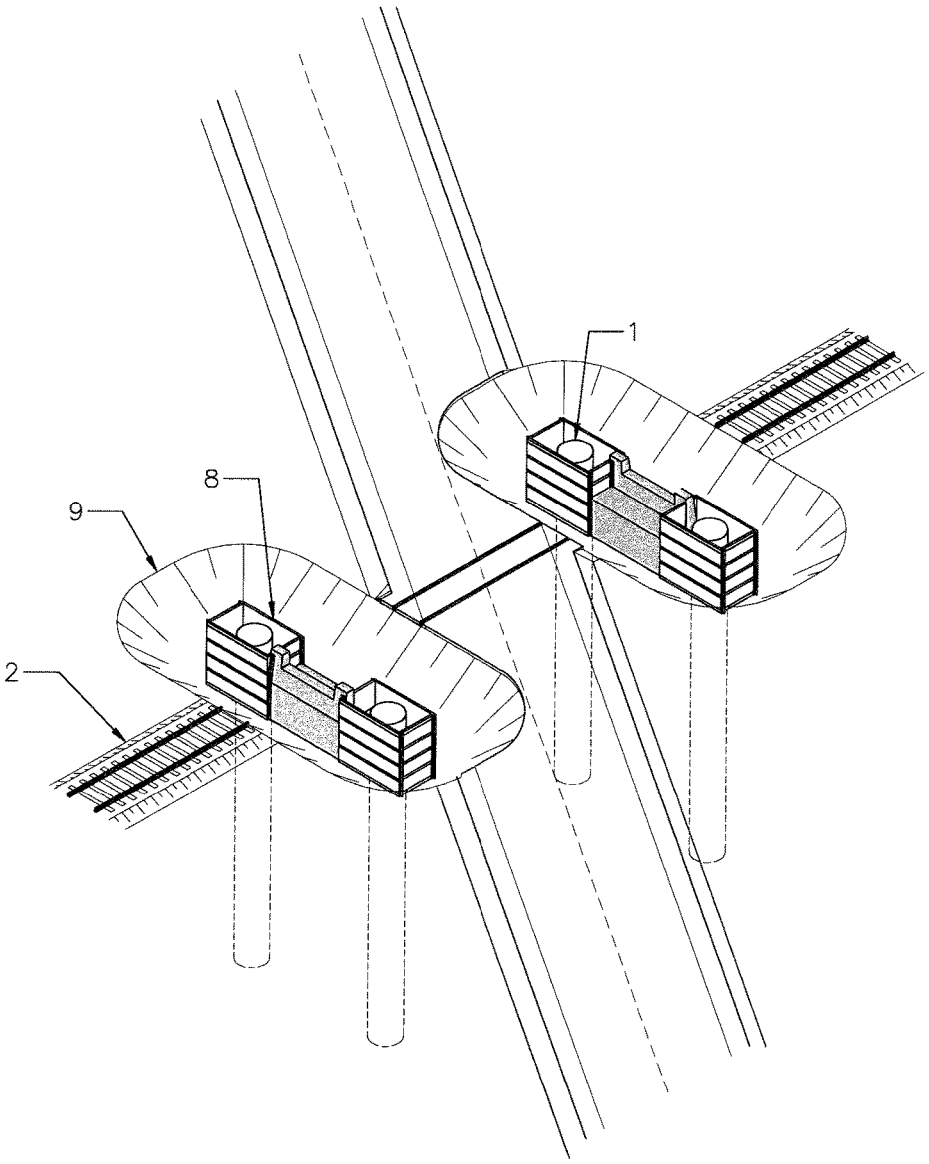
FIG. 16 is a schematic detailing placement of the pre-cast assembly (8) over the steel caisson liners (1) in trench (9) excavated across the thoroughfare. Rail track (2) is also shown.
Figure 17:
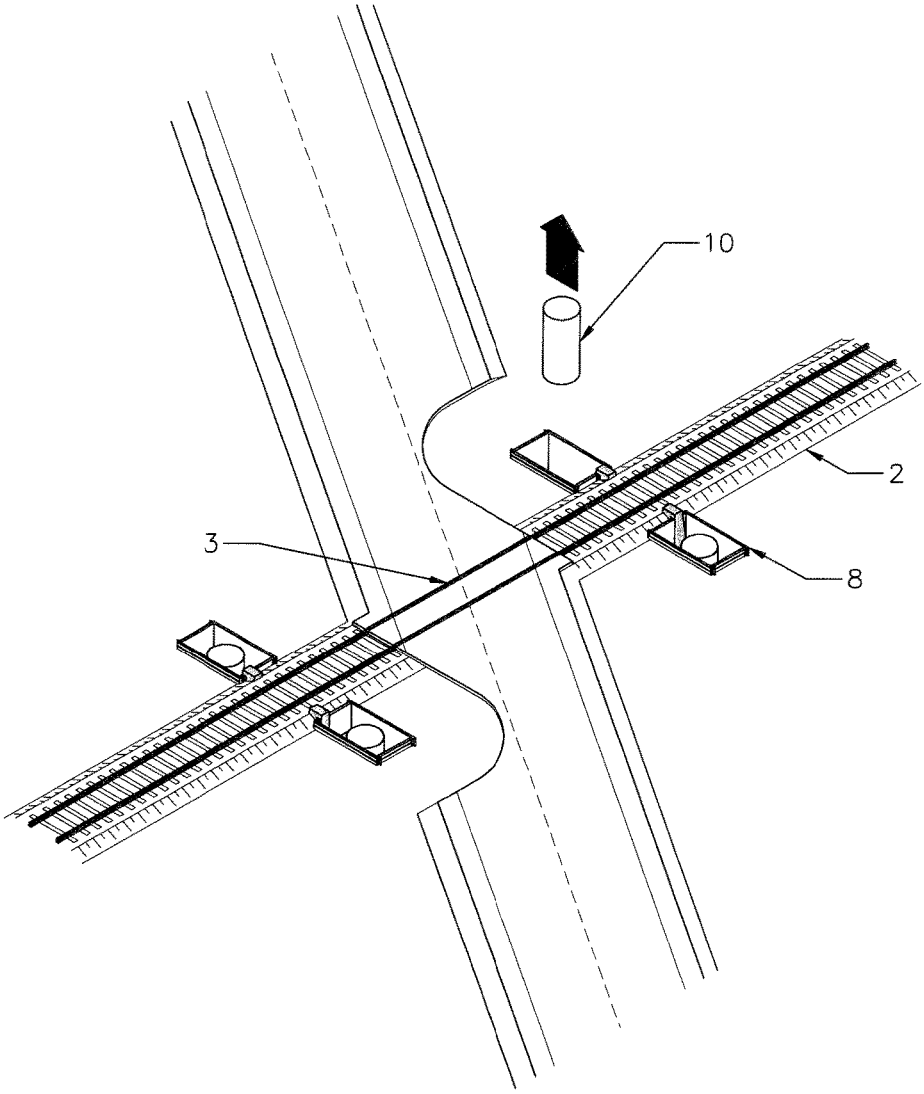
FIG. 17 is a schematic detailing reinstatement of thoroughfare. Also shown is removal of a piece of the steel caisson liner (10), rail track (2), pre-cast assembly (8) and location of level crossing (3).

Referring to FIG. 15, modular trench boxes (5) are connected using bolts (6) to the pre-cast elements (4) to form the precast assembly. The illustrated pre-cast element includes a notch and together with modular trench boxes is configured to facilitate formation of ballast walls. When the caisson liners are installed and the precast segments are assembled with the trench boxes (8), the thoroughfare is temporarily closed and a trench is excavated (9) across the thoroughfare, large enough to accept the precast assembly (8) as shown in FIG. 16. The precast assembly is positioned in the trench (9), by mobile crane for example, at its final location, orientation and elevation. An integral channel guide is placed under the assembly (8) and spans between the caisson liners. Once the assembly is in place, the trench is filled with ballast material, burying the precast assembly (8), and the thoroughfare can be temporarily reinstated as shown in FIG. 17.

Figure 18:
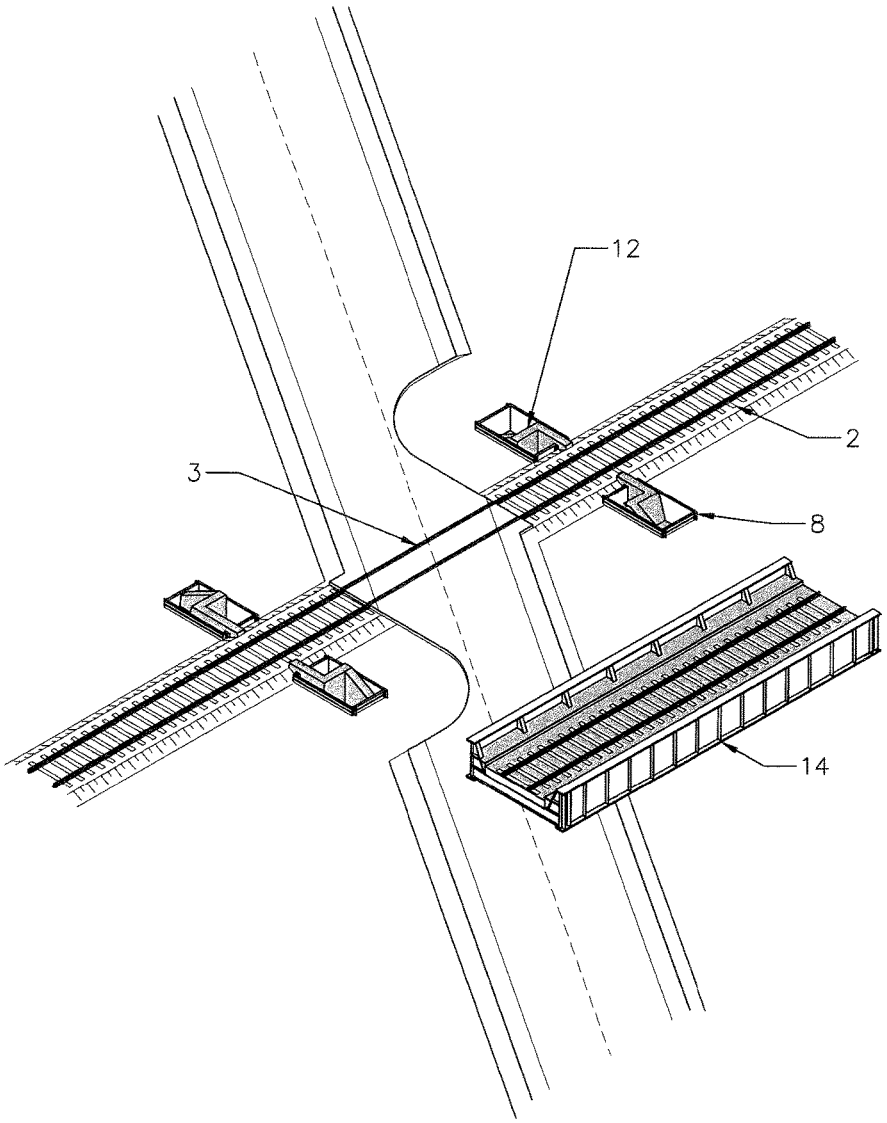
FIG. 18 is a schematic detailing completion of substructure elements. Ballast walls (12), and top of pre-cast assembly (8) are shown. Also shown is a completed rail bridge span (14) rail track (2) and location of level crossing (3).
Figure 19:
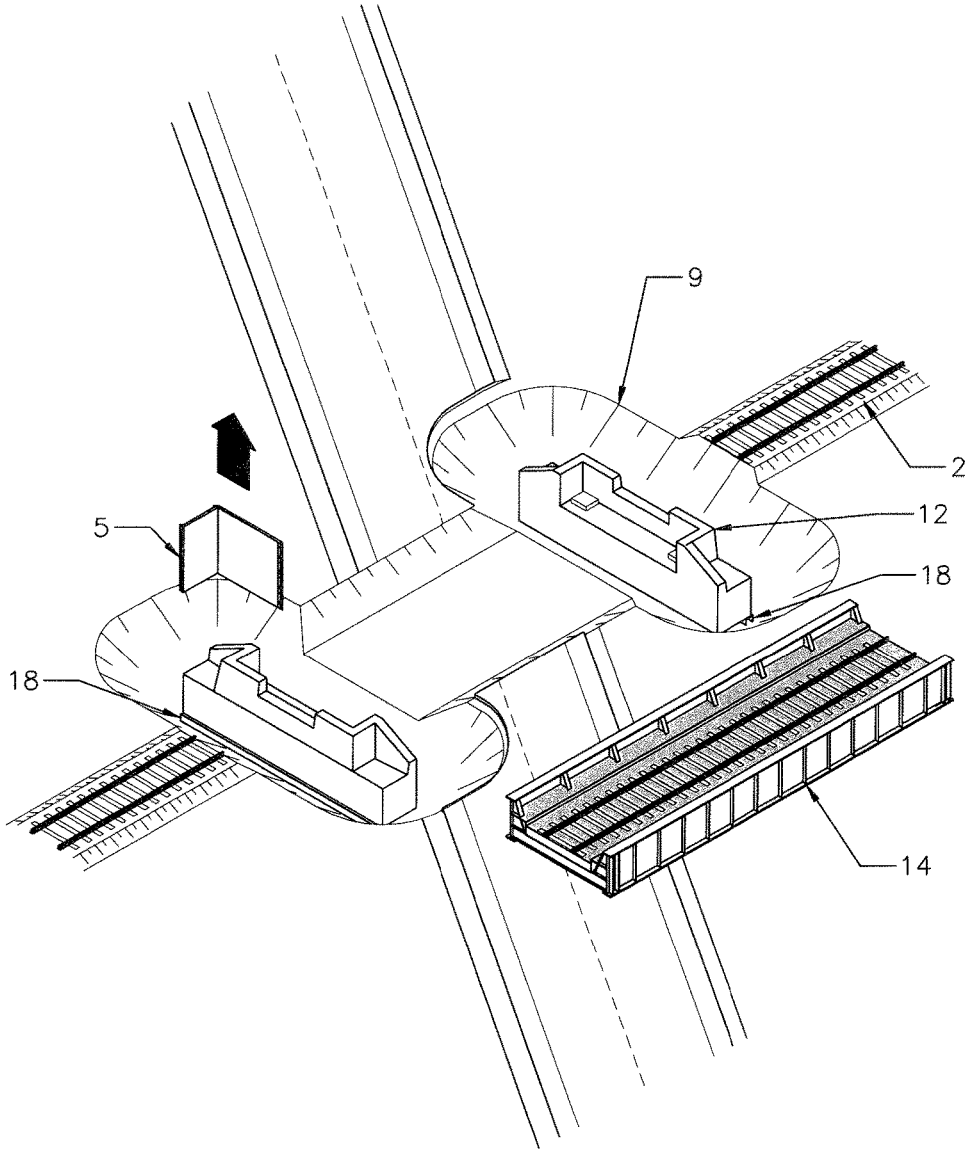
FIG. 19 is a schematic detailing placement/installation of the bridge span. Ballast walls (12), integral channel (18) and trench box piece (5) are shown. Also shown is a completed rail bridge span (14), trench (9) and rail track (2).
Figure 20:
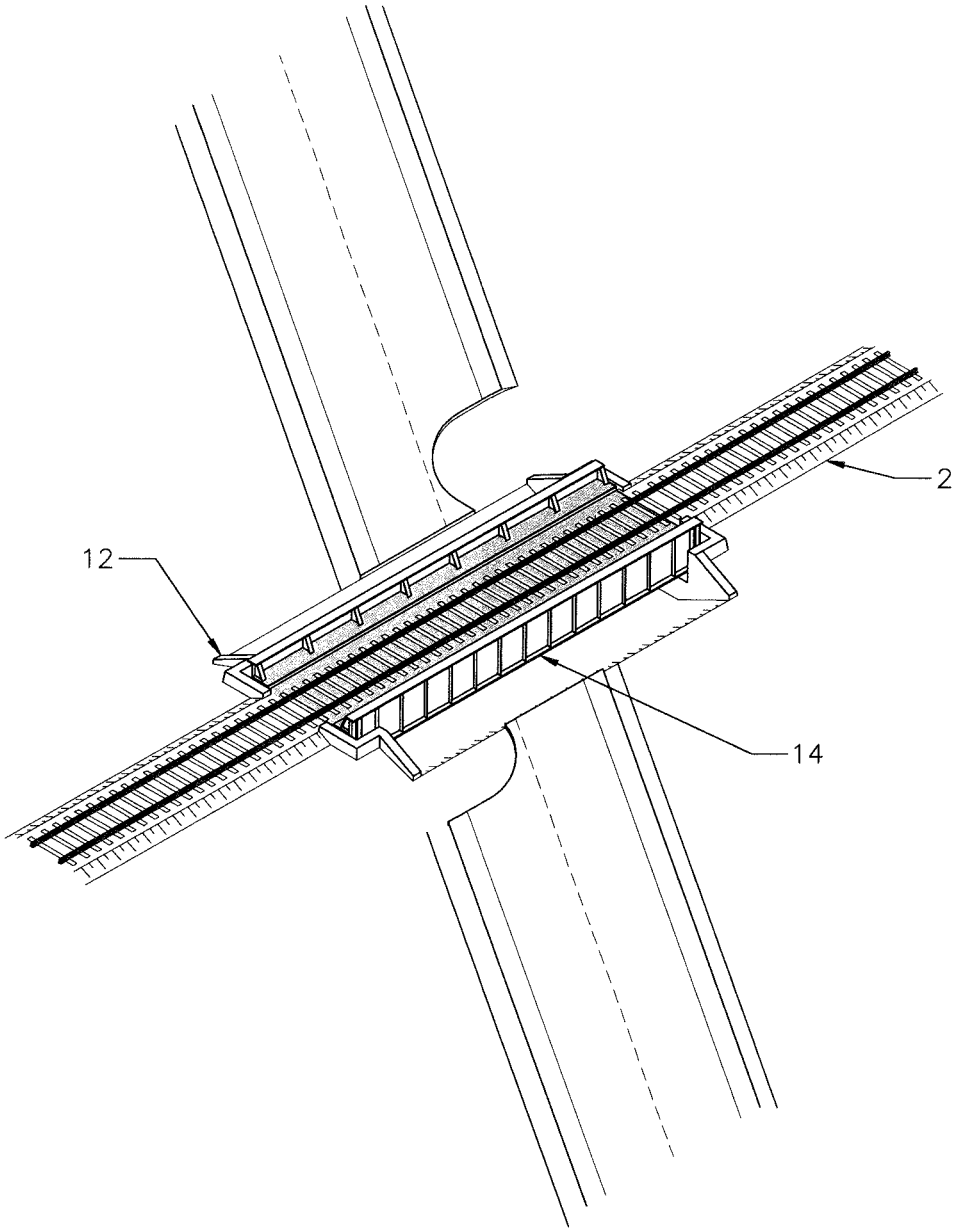
FIG. 20 is a schematic detailing placement of the bridge span, ballast wall (12), bridge span (14) and rail track (2).

The construction of the caissons, linking of the precast segments to the caissons, completion of ballast walls (12), bearings (13) and finishing works, as well as assembly and installation of the bridge span (14), is similar to that as set forth above and is as shown in FIGS. 18, 19 and 20.

Figure 21:
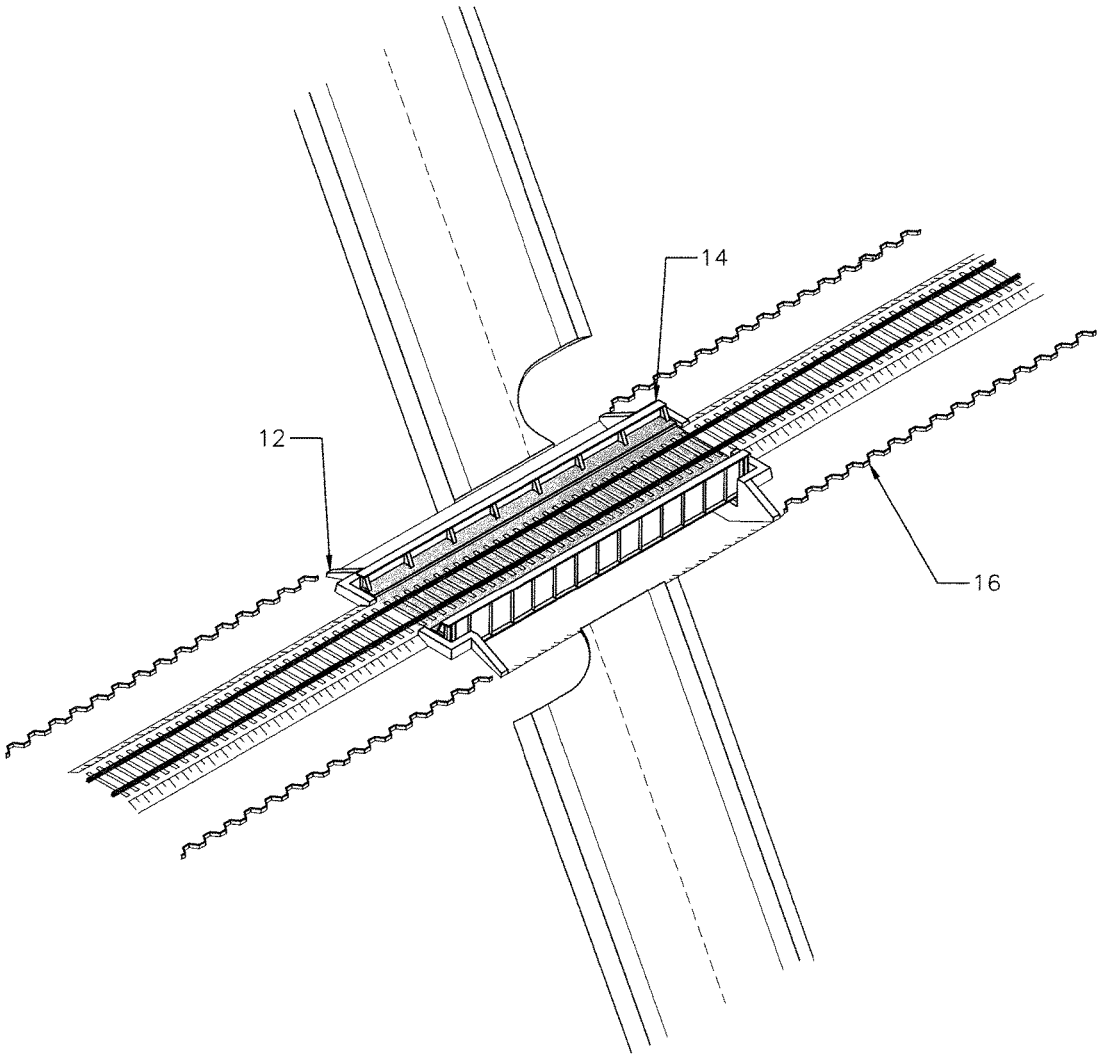
FIG. 21 is a schematic detailing temporary protection system comprising sheet pile wall (16) to protect bridge prior to excavation. Ballast wall (12) and bridge span (14) is also shown.
Figure 22:
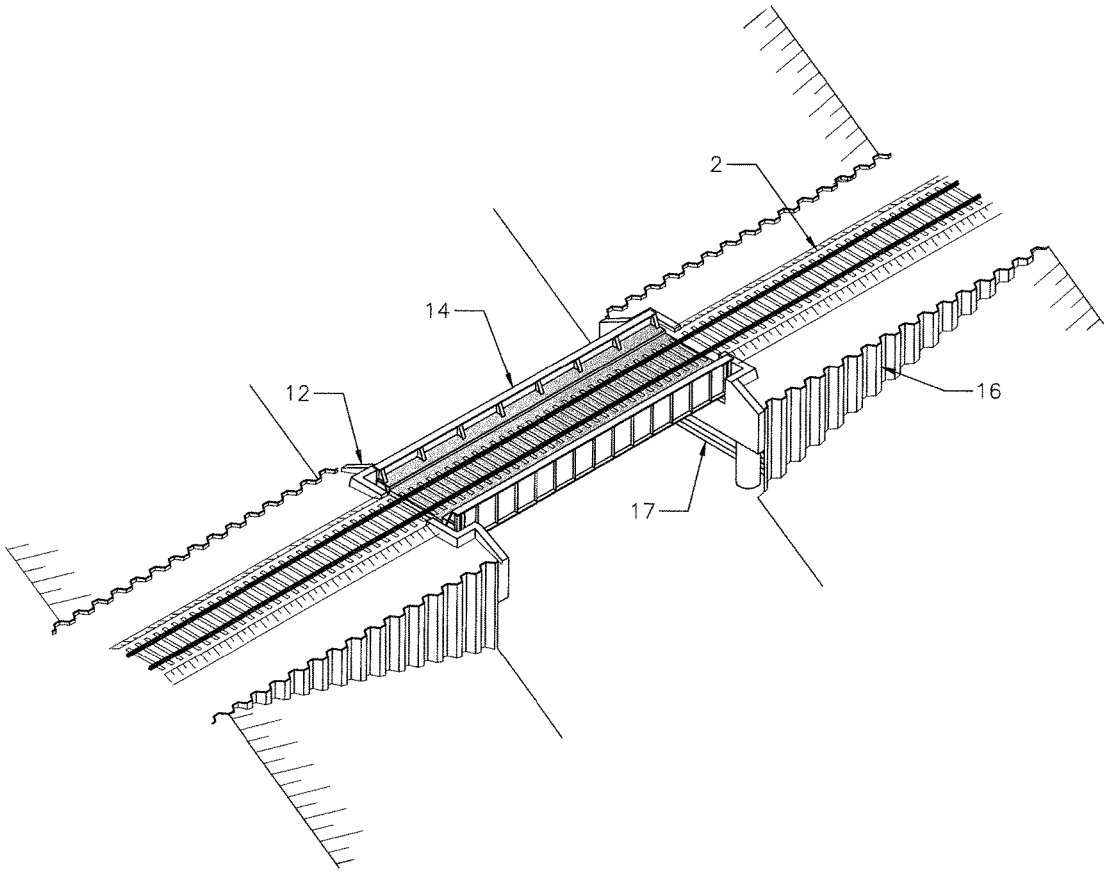
FIG. 22 is a schematic detailing abutment face excavation showing sheet pile wall (16) and steel walers (17). Also shown are ballast wall (12), bridge spans (14) and rail track (2).
Figure 23A:
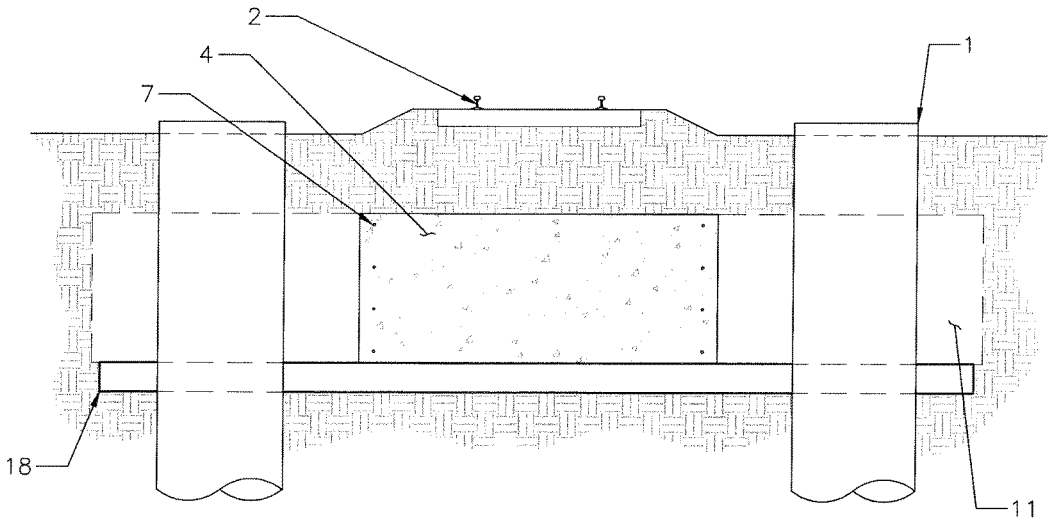
FIGS. 23A to 23D are schematics detailing abutment face excavation showing ballast walls (12), bridge span (14) bearings (13), integral channel (18) and walers (17).
Figure 23B:
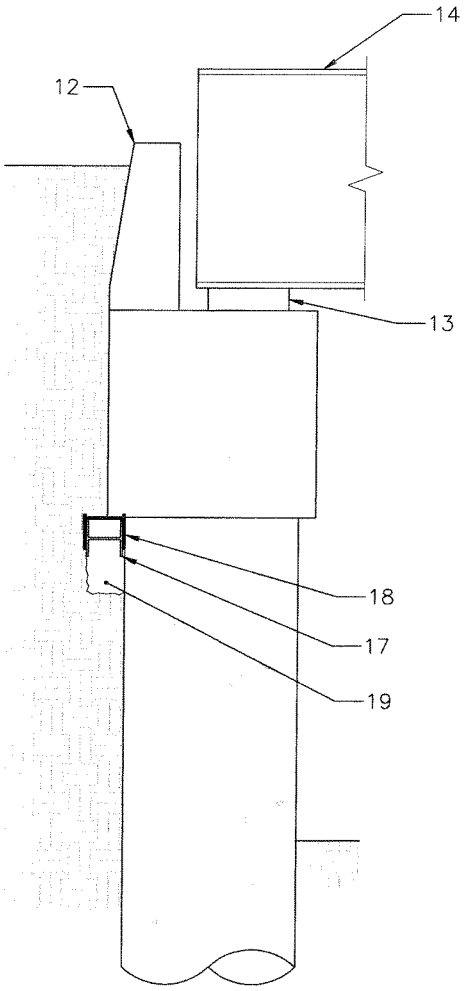
Figure 23C:
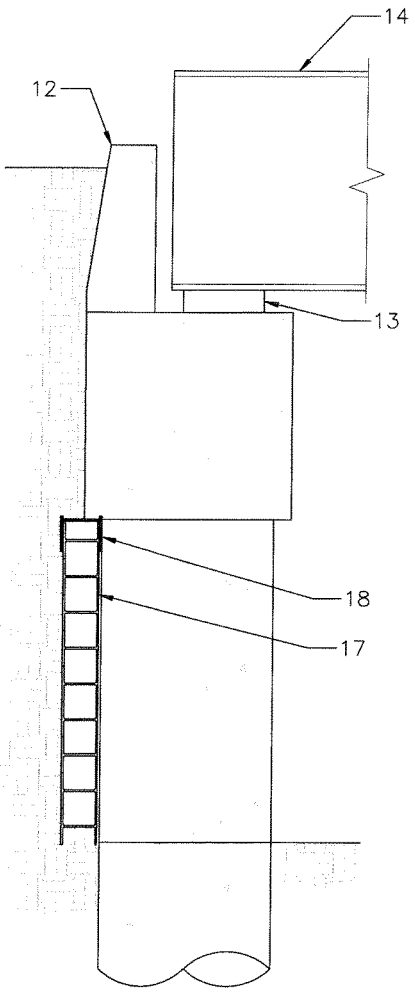
Figure 23D:
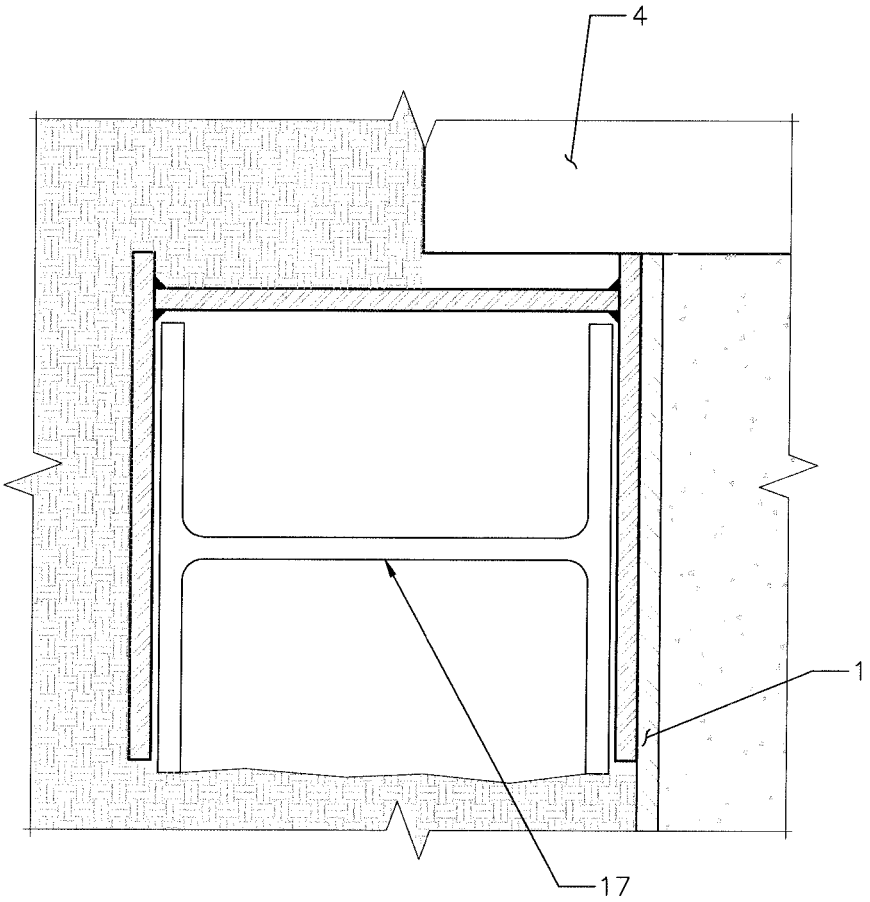
Figure 24:
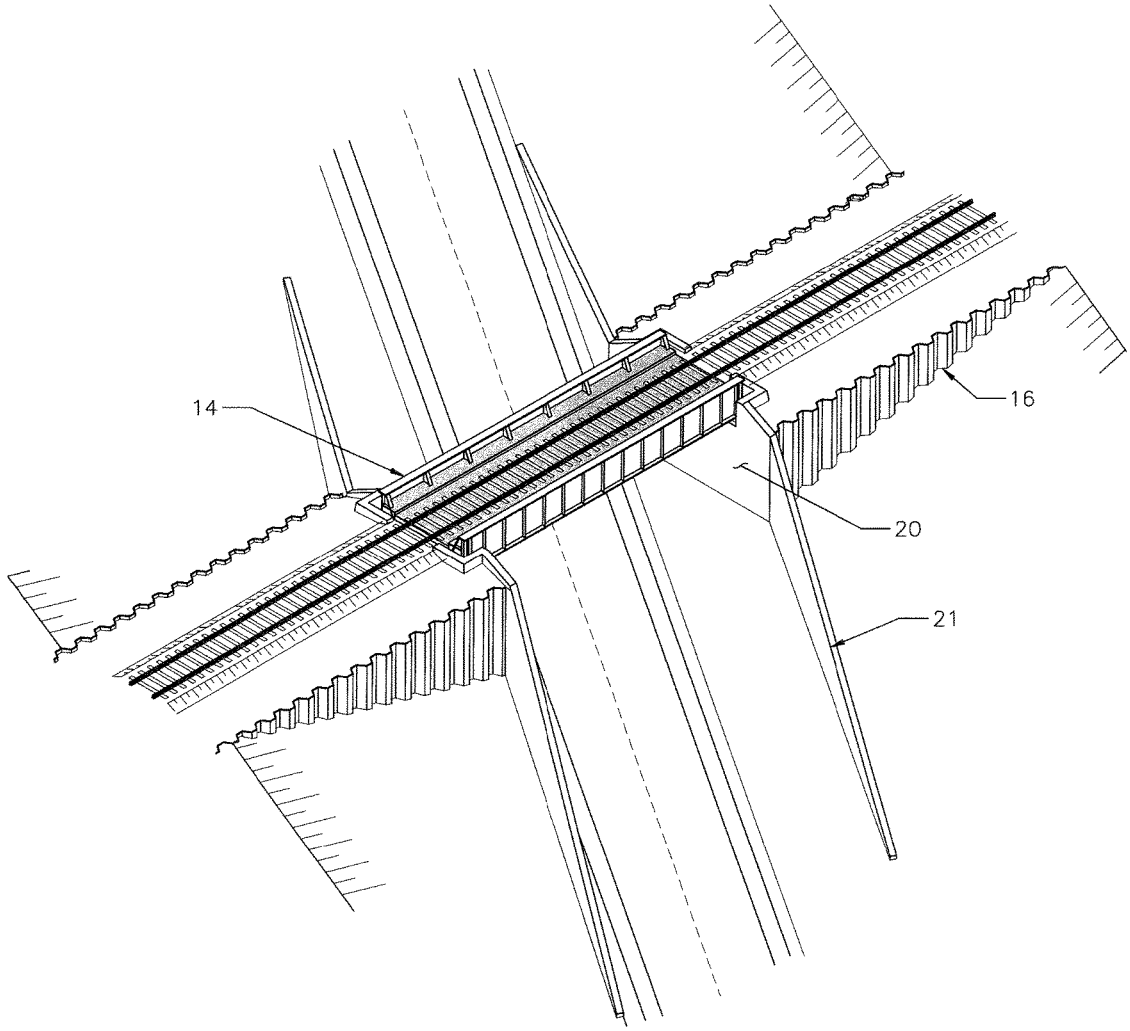
FIG. 24 is a schematic detailing single span rail bridge with concrete abutment wall (20) and permanent retaining wall (21). Also shown are sheet pile wall (16) and bridge span (14).
Figure 25:
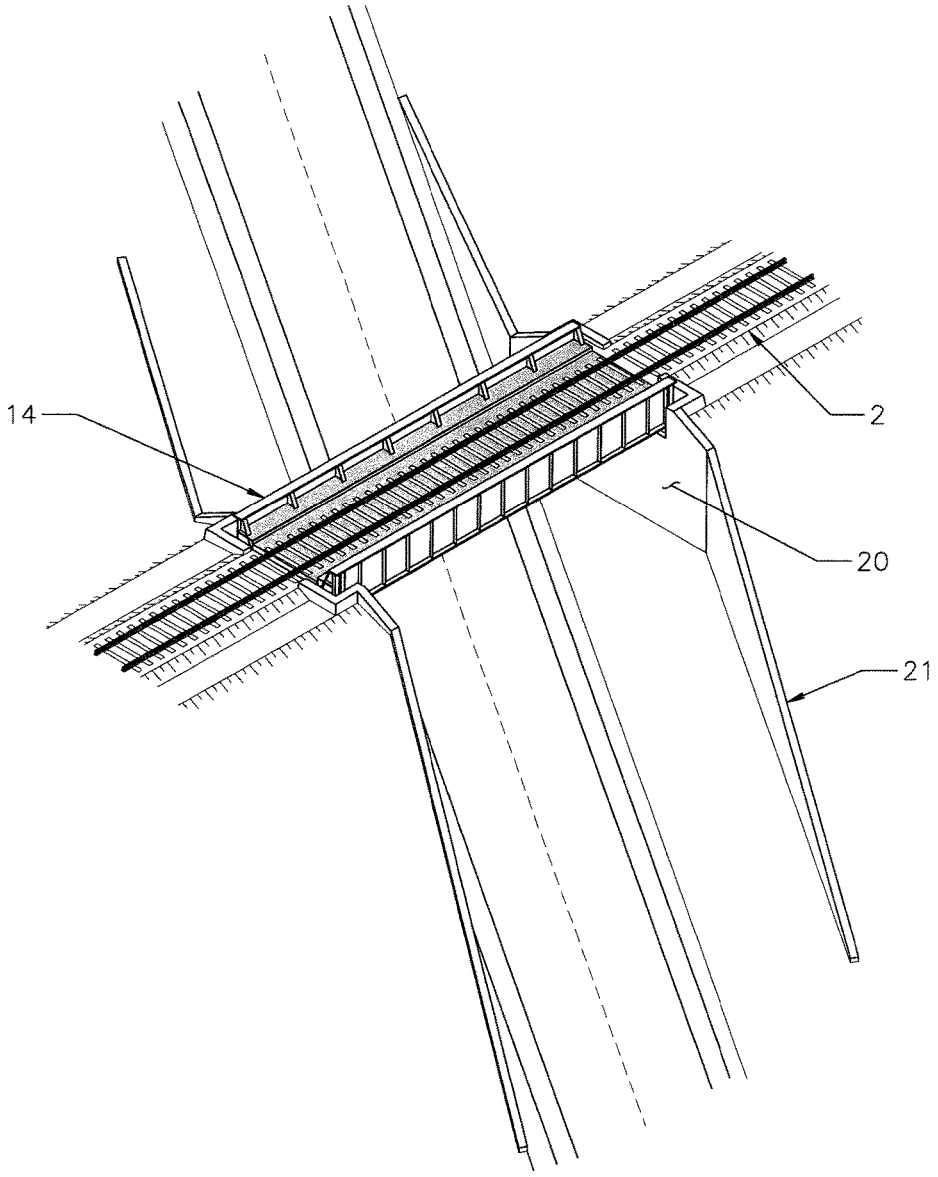
FIG. 25 is a schematic detailing a completed single span rail bridge with concrete abutment wall (20) and permanent retaining wall (21). Also shown are rail track (2) and bridge span (14).

Referring to FIG. 21, prior to excavating under the superstructure, temporary protection systems (sheet pile wall (16), soldier pile wall, slurry wall, etc.) are installed as required at each corner of the structure. The vertical excavation faces under the abutment caps are supported using steel walers (17) slid into place behind the caissons along the integral channel guide (18). In the illustrated embodiment, the walers (17) are commonly available steel I-beam sections and installed as shown in FIGS. 22 and 23A to 23D. The walers (17) span from caisson to caisson, substantially perpendicular to the overhead thoroughfare, and are designed to retain the soil behind the abutment. After installation of the first waler, the excavation will then proceed locally (19) under the waler (17) causing it to descend to the bottom of the local excavation (19) (approximately the width of one waler) as shown in FIG. 23A. A new waler (17) will then be slid into place along the integral guide channel (18) and the local excavation process will be repeated causing all walers to descend. This procedure to install walers is repeated until the design depth of excavation is reached as shown in FIG. 23B. If required any void behind the walers is filled with pressurized flowable grout. Once the excavation and installation of waler is completed, a concrete abutment wall (20) is poured in front of the walers, joining the caissons as shown in FIG. 24. In the illustrated example a permanent retaining walls (21) is installed at each corner of the structure, in front of the temporary protective measures (16). Once the abutment walls (20) have cured, the walers (17) and integral guide channels are slid out individually and the remaining voids filled in with pressurized flowable grout. The removed walers and integral guide channels could then be re-used for any future projects. Once all substructure, superstructure, and excavation works are completed, the detoured right-of-way is re-aligned under the bridge and final landscaping can be done as shown in FIG. 25.

Example Three

Rigid Frame Design Roadway

Figure 26:
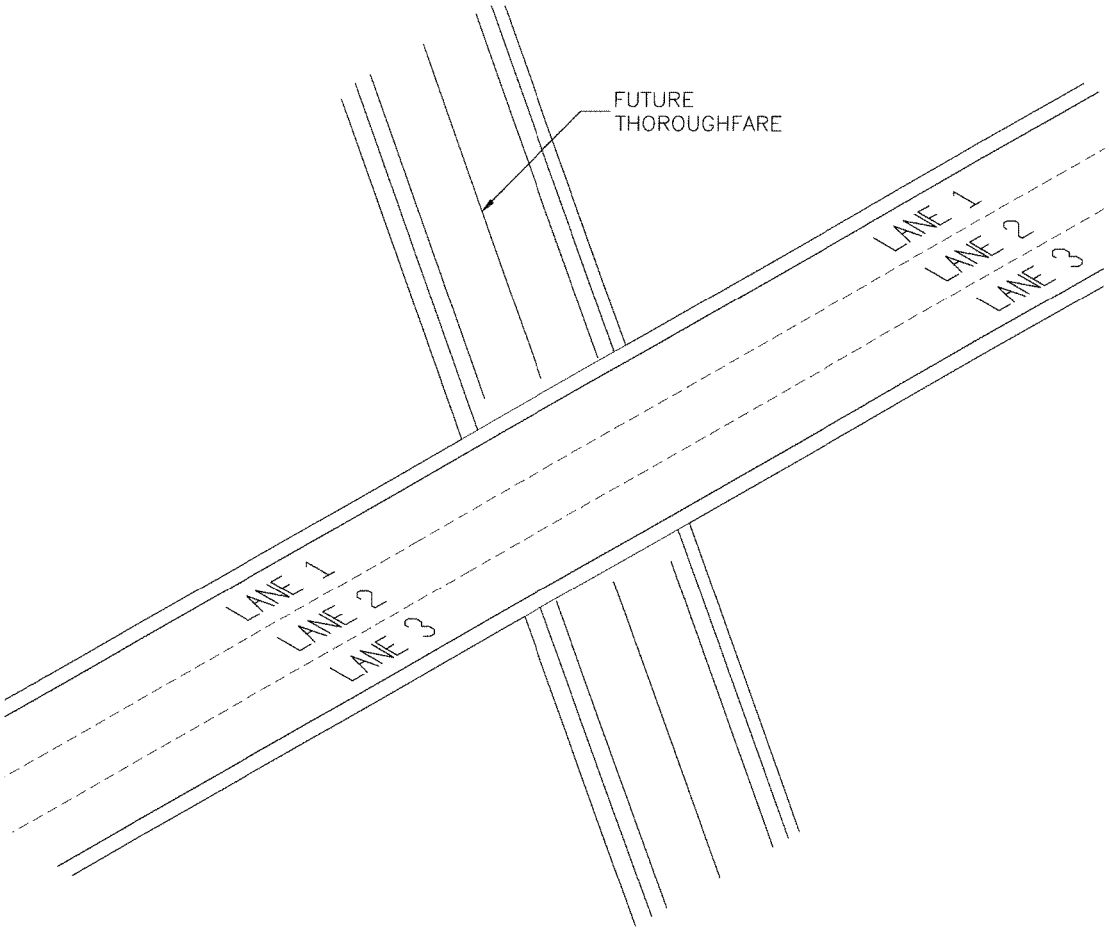
FIG. 26 is a schematic detailing a road intersection (3) with thoroughfare to be realigned.

This example details construction of new underpasses with integral abutments under multi-lane roadways with only single lane closure of the existing thoroughfare at a given time. A new rigid frame structure to be constructed under three lane roadway is illustrated. The prior construction conditions are shown in FIG. 26.

Figure 27:
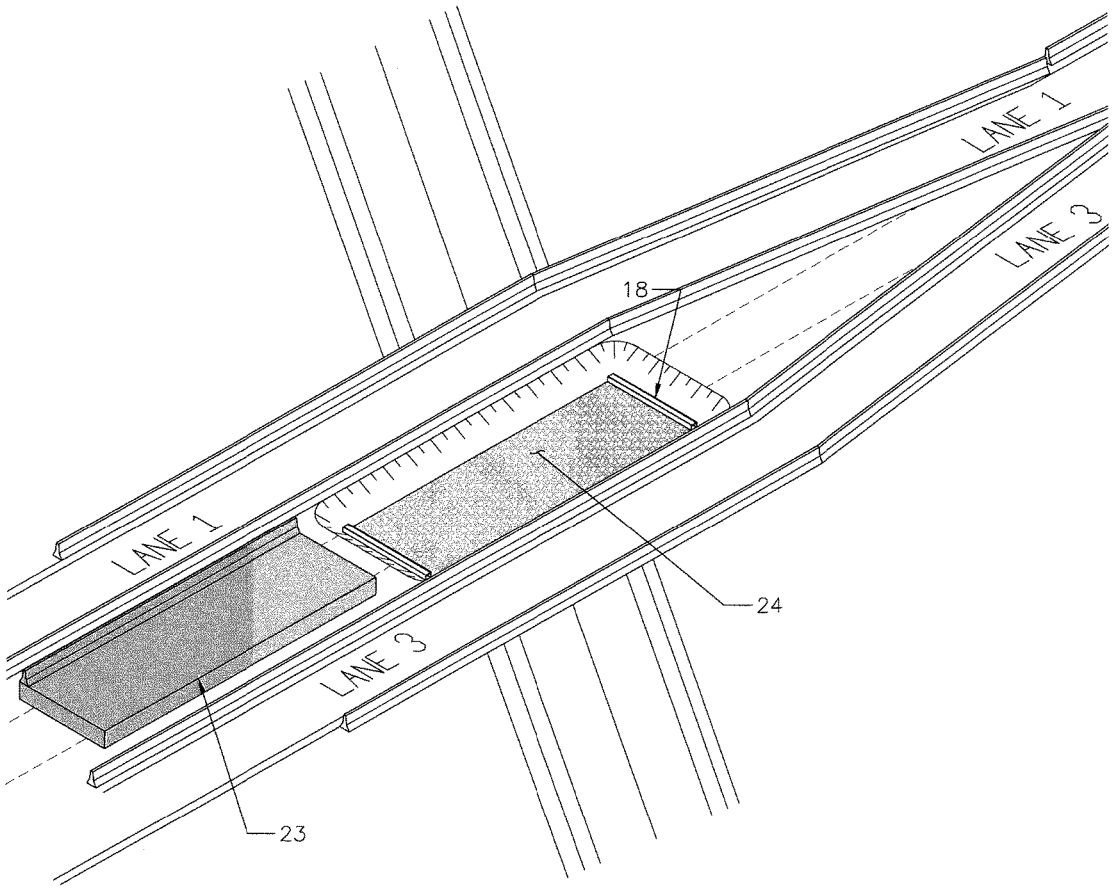
FIG. 27 is a schematic detailing centre lane excavation on the intersection shown in FIG. 26 showing a full length, partial width segment of concrete deck (23), level granular base (24) and previously position integral channels (18).

Referring to FIG. 27, Lanes 1 and 3 of the three lane roadway are realigned, and a construction area in between is protected with traffic control barriers (TCB). Lane 2 is temporarily closed and traffic on the two lane roadway is re-routed around the construction site.

Lane 2 of the three lane road is excavated and a levelled granular base (24) is prepared in the excavation site and integral channels installed. Referring to FIG. 27, a full length, partial width segment of the concrete deck (23) is precast integrally with the abutment segments. The abutment segments are optionally a more heavily reinforced strip at each end of the precast segment.

Figure 28:
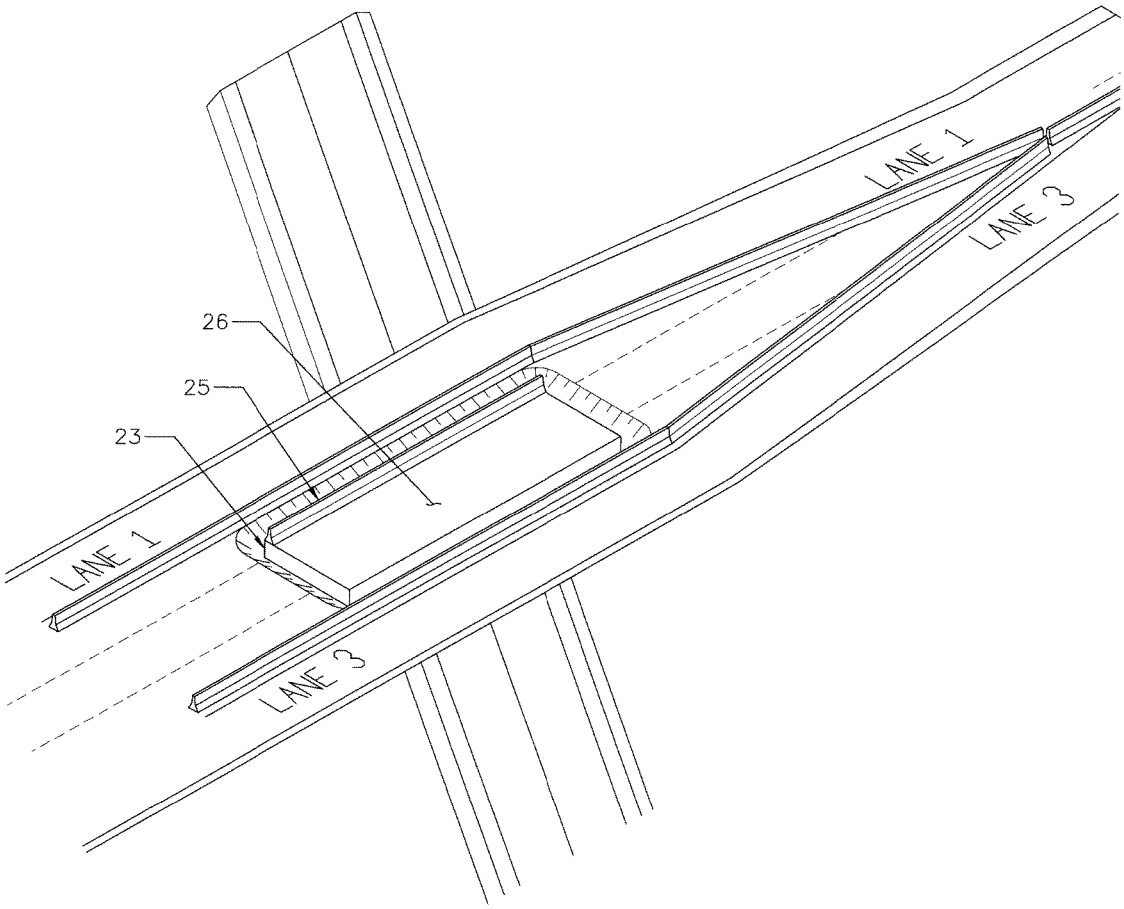
FIG. 28 is a schematic detailing precast segment placement showing a full length, partial width segment of concrete deck (23), temporary traffic barriers (25) and waterproofing and asphalt wearing surface (26).

The entire segment is placed onto to the levelled granular base (24) within a trench on the overhead thoroughfare over the previously positioned integral channel guides (18) as shown in FIGS. 27 and 28. In the illustrated embodiment, the width of the abutment/deck segment would typically allow for one travel lane and traffic control barriers along each edge. Optionally, the segment could also be placed with temporary traffic barriers (25) and/or the waterproofing and asphalt wearing surface (26) pre-installed on the assembly to minimize Lane 2 closure time. Once the precast deck/abutment segment is placed, the trench is backfilled and Lane 2 is reopened to traffic.

Figure 29:
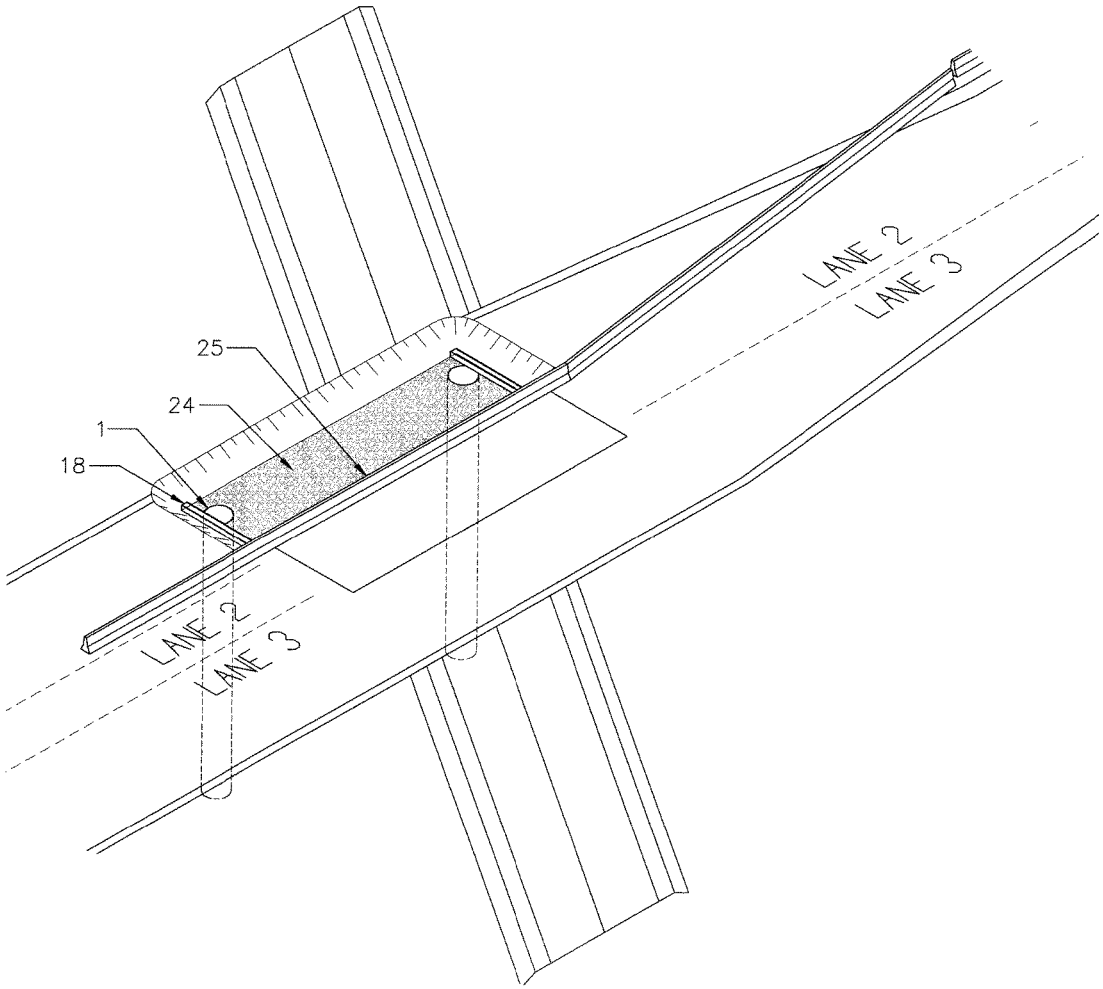
FIG. 29 is a schematic detailing first lane excavation on the intersection shown in FIGS. 27 and 28 showing steel caisson liners (1), integral channels (18), level granular base (24) and temporary traffic barriers (25).
Figure 30:
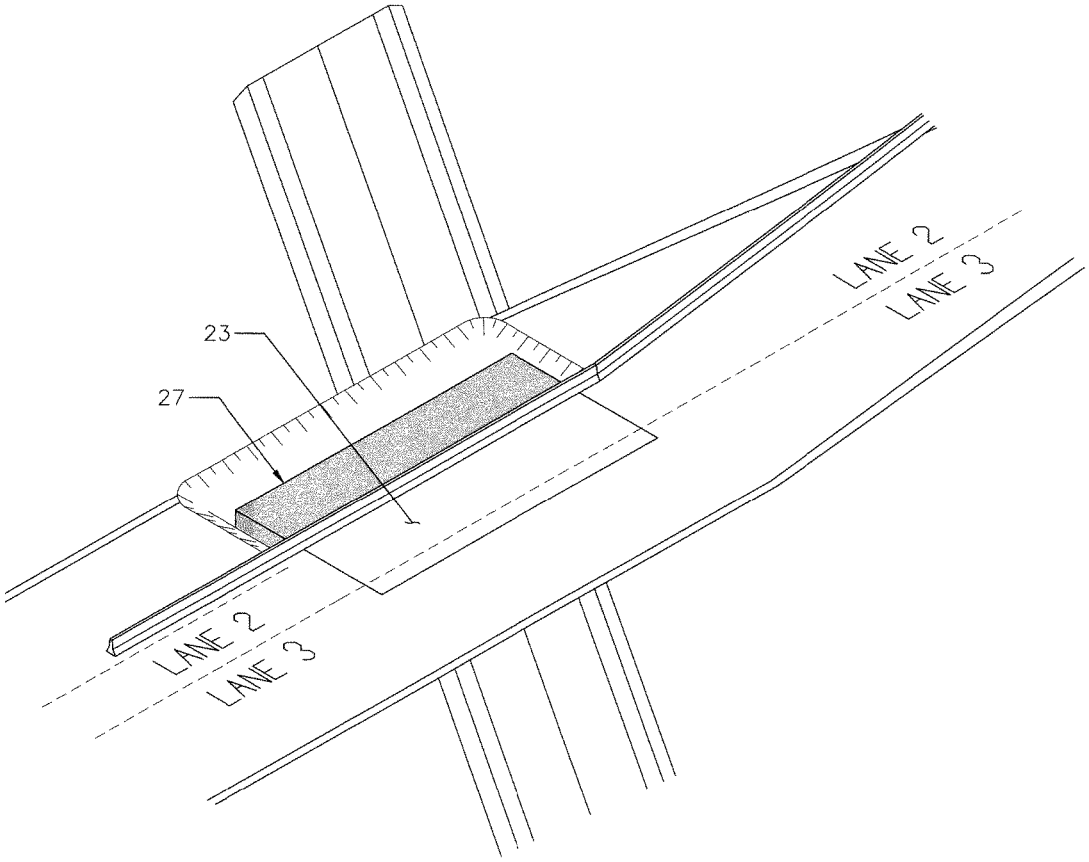
FIG. 30 is a schematic detailing extension of partial width segment of concrete deck (23) with cast-in-place concrete (27).
Figure 31:
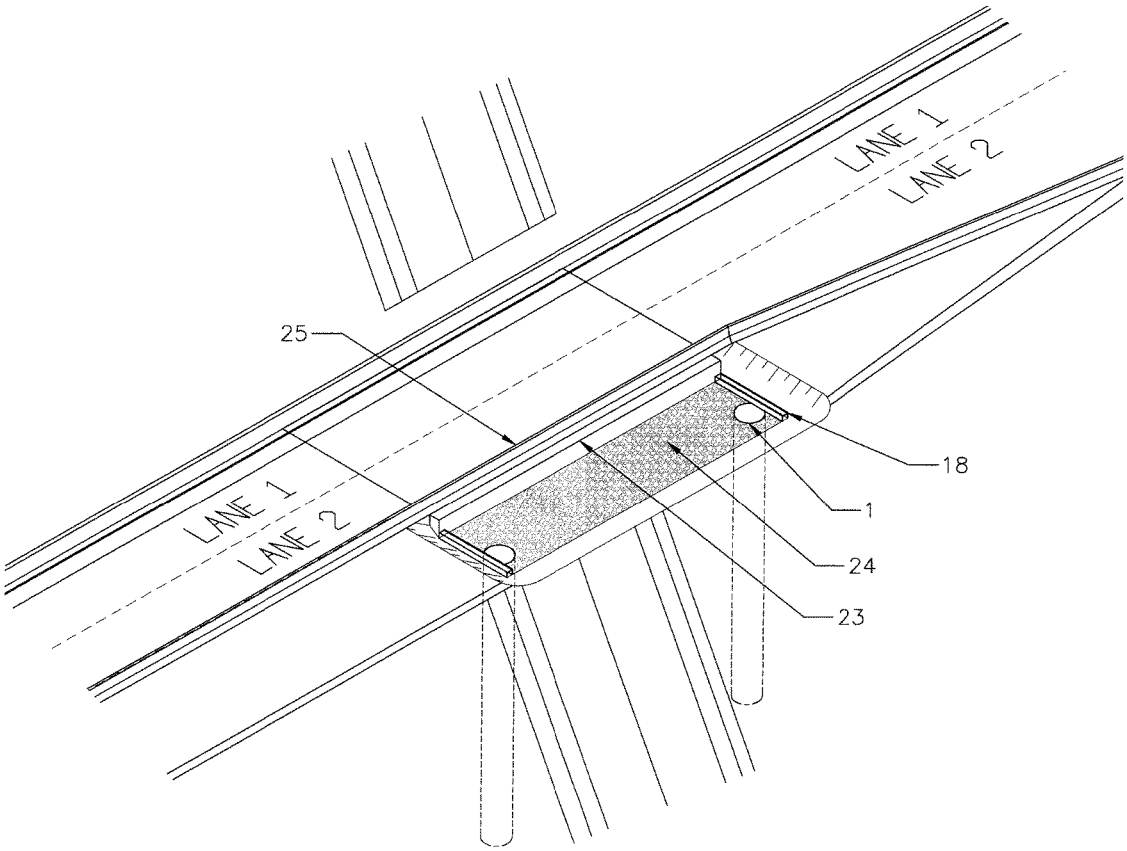
FIG. 31 is a schematic detailing third lane excavation on the intersection shown in FIGS. 27 to 29 showing steel caisson liners (1), integral channels (18), full length, partial width segment of concrete deck (23), level granular base (24) and temporary traffic barriers (25).
Figure 32:
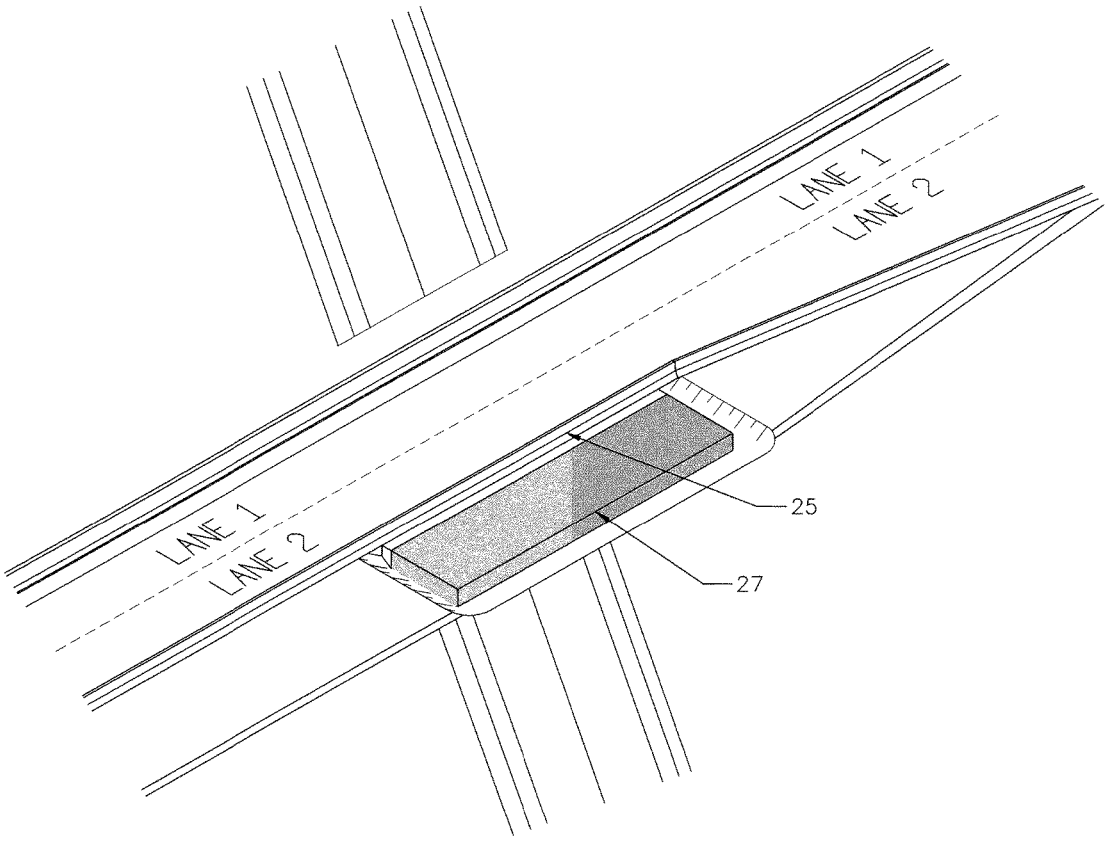
FIG. 32 is a schematic detailing extension of partial width segment of concrete deck with cast-in-place concrete (27) into the third lane excavation site. Traffic barriers (25) are also shown.
Figure 33:
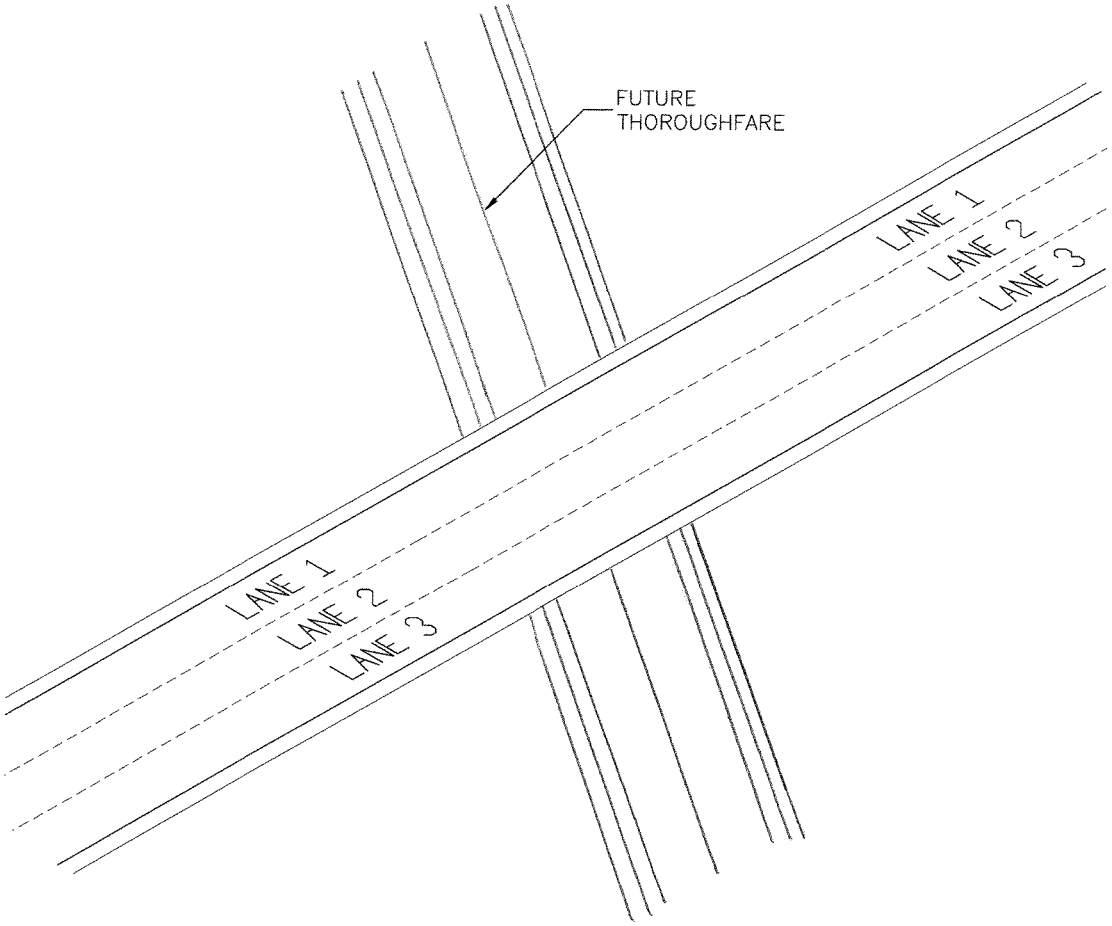
FIG. 33 is a schematic detailing completed superstructure.
Figure 34:
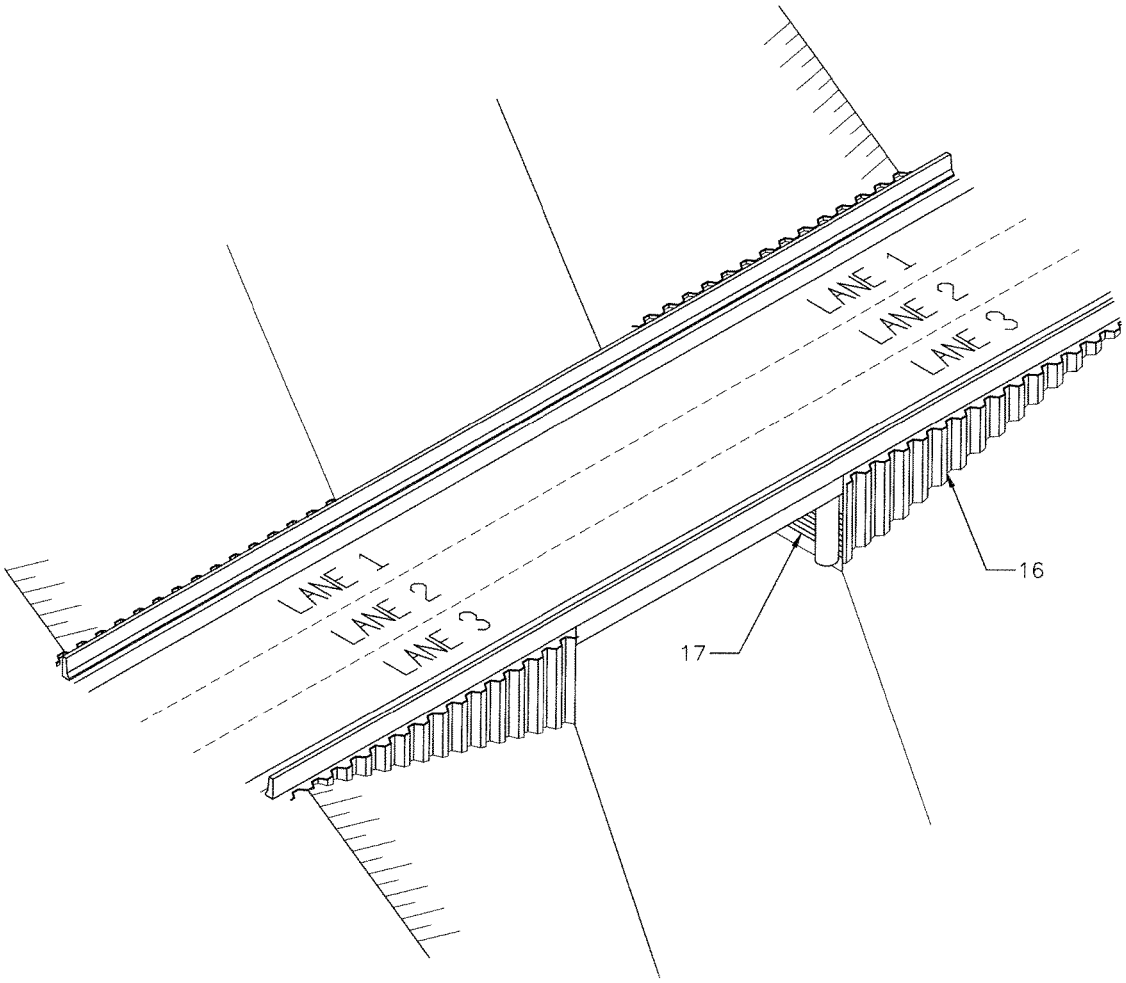
FIG. 34 is a schematic detailing excavation of underpass showing sheet pile wall (16) and steel walers (17).
Figure 35:
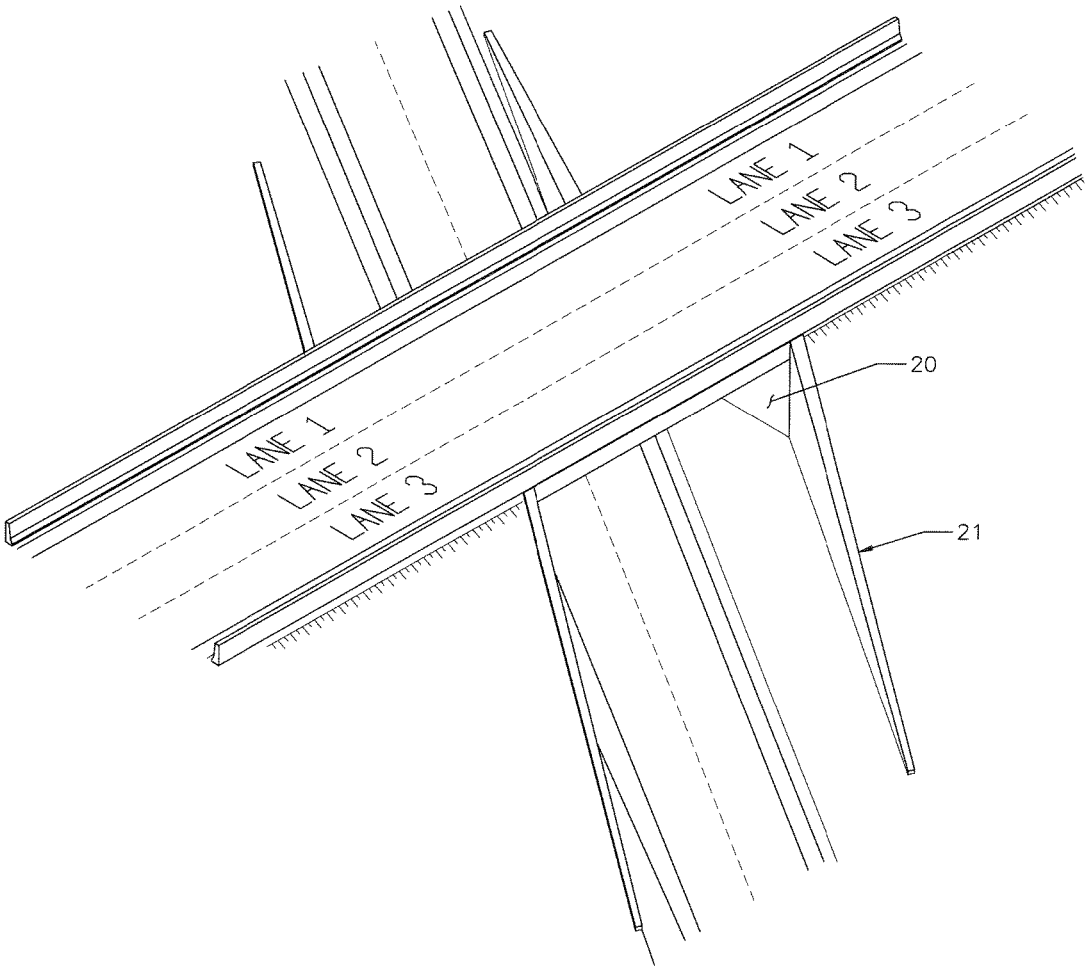
FIG. 35 is a schematic detailing a completed bridge with concrete abutment wall (20) and permanent retaining wall (21).

Following re-opening of Lane 2, Lane 1 is temporarily closed and steel caisson liners (1) are installed as shown in FIG. 29 and the caissons are completed. The integral channel guides (18) previously installed are extended, and the precast segment (23) is linked to the caissons with cast-in-place concrete (27) FIG. 30. After installation of waterproofing and asphalt wearing surface Lane 1 is permanently reopened. A similar series of steps is repeated on the opposite side of the precast segment during Lane 3 closure as shown in FIGS. 31 and 33. The superstructure is completed and all three lanes of traffic are opened. The excavation and abutment wall construction is similar to the procedure illustrated in Example Two as shown on FIGS. 23 & 34. Once all substructure, superstructure, and excavation works are completed, the road can be constructed under the bridge and final landscaping can be done as shown in FIG. 35.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

What is claimed is:

1. A method of protecting a vertical face excavation under a superstructure supported by caissons, the method comprising:

a) partially excavating a vertical face between two caissons under the superstructure, wherein an integral channel is provided between the two caissons proximal to the superstructure; and b) sliding a first steel waler horizontally along the integral channel guide;

c) excavating under the installed first steel waler such that the first steel waler descends to the bottom of the excavation site; and d) sliding a second waler on top of the first steel waler.

2. The method of claim 1, further comprising after step e) excavating under the first steel waler such that the first steel waler and second steel waler descend to the bottom of the excavation site; and f) sliding a third waler on top of the second steel waler.

3. The method of claim 2, further comprising g) excavating under the first steel waler such that the installed walers descend to the bottom of the excavation site; and h) sliding a further waler on top of the top waler.

4. The method of claim 3, further comprising repeating steps g) and h).

5. The method of claim 4, comprising filling voids behind walers with pressurized flowable grout.

6. The method of claim 4, comprising pouring a concrete abutment wall in front of waters.

7. The method of claim 6, further comprising removing walers and integral guide channels.

8. The method of claim 6, further comprising filling voids resulting from removal of the walers and integral channel guide with pressurized flowable grout.

9. The method of claim 1, wherein the waler is a steel I-beam.

10. The method of claim 1, wherein the excavation depth under an installed waler is approximately the depth of one waler.

* * * * *